US009865961B2

(12) United States Patent
Shibaya et al.

(10) Patent No.: US 9,865,961 B2
(45) Date of Patent: Jan. 9, 2018

(54) CONNECTOR AND ELECTRICAL CONNECTION DEVICE

(71) Applicant: J.S.T. Mfg. Co., Ltd., Osaka-shi (JP)

(72) Inventors: Takahiro Shibaya, Miyoshi (JP); Yasuo Kita, Miyoshi (JP); Yuichi Yoshiki, Miyoshi (JP); Nahoko Miura, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/443,285

(22) Filed: Feb. 27, 2017

(65) Prior Publication Data

US 2017/0279215 A1 Sep. 28, 2017

(30) Foreign Application Priority Data

Mar. 25, 2016 (JP) ..... 2016-062281

(51) Int. Cl.
*H01R 13/516* (2006.01)
*H01R 13/631* (2006.01)
*H01R 13/639* (2006.01)

(52) U.S. Cl.
CPC ..... *H01R 13/516* (2013.01); *H01R 13/631* (2013.01); *H01R 13/639* (2013.01)

(58) Field of Classification Search
CPC ... H01R 13/516; H01R 13/631; H01R 13/639
USPC ..... 439/157, 347
See application file for complete search history.

(56) References Cited

U.S. PATENT DOCUMENTS 5,681,175 A * 10/1997 Busse ..... H01R 13/62977 439/157
6,168,445 B1 * 1/2001 Seutschniker ... H01R 13/62933 439/157
6,213,795 B1 * 4/2001 Drescher ..... H01R 13/62977 439/152
6,361,356 B1 * 3/2002 Heberlein ..... H01R 13/62977 439/157
8,215,970 B2 * 7/2012 Shamoto ..... H01R 13/5213 439/157
8,246,365 B2 * 8/2012 Shishikura ..... H01R 13/62944 439/157
9,048,579 B2 6/2015 Itou
(Continued)

FOREIGN PATENT DOCUMENTS

JP 2014-99267 A1 5/2014

*Primary Examiner* — Alexander Gilman
(74) *Attorney, Agent, or Firm* — Kratz, Quintos & Hanson, LLP

(57) ABSTRACT

A connector including: a housing; a cover that is fixed to the housing so as to cover an opening of the housing; a slider that is housed within the housing, is provided so as to be slidable along the housing, and is configured to slide so that the housing is fitted to the partner connector; an operation-target part configured to slide the slider upon being operated; and a lock mechanism that includes a slider engagement part that is formed on the slider, and a second cover engagement part that is formed on the cover, and is configured such that the slide engagement part engages with the second cover engagement part in a situation where fitting of the housing and the partner connector to each other is complete, so that the cover is prevented from being separated from the slider.

5 Claims, 17 Drawing Sheets

(56) References Cited

U.S. PATENT DOCUMENTS

| | | | | |
|---|---|---|---|---|
| 9,160,109 | B2 * | 10/2015 | Mauney | H01R 13/6275 |
| 2014/0134862 | A1 * | 5/2014 | Itou | H01R 13/62944<br>439/157 |

* cited by examiner

CONNECTOR AND ELECTRICAL CONNECTION DEVICE

CROSS-REFERENCE TO RELATED APPLICATION

This application claims priority to Japanese Patent Application No. 2016-062281. The entire disclosure of Japanese Patent Application No. 2016-062281 is hereby incorporated herein by reference.

BACKGROUND OF THE INVENTION

1. Field of the Invention

The present invention relates to a connector and an electrical connection device that is provided with the connector, and belongs to, in particular, the field of techniques for improving the fitting performance of a housing and a cover that are included in the connector.

2. Description of Related Art

There is a conventionally-known connector characterized in that, when the connector is to be fitted to a partner connector, fitting of the connectors to each other can be completed by operating a lever that is included in the connector, in a situation where the connectors are loosely fitted to each other (see JP 2014-99267A, for example). In this connector, as shown in FIG. 9, a guide member 9 that is formed in a cover 3 is fitted to a guide receiver 15 that is formed in a connector housing (housing) 1, and thus the cover 3 can be fixed to the connector housing 1.

SUMMARY OF THE INVENTION

In the connector disclosed in JP 2014-99267A, if the guide member 9 becomes separated from the guide receiver 15 or they are damaged due to a strong impact or the like, both the cover 3 and the lever 4 become separated from the connector housing 1.

The present invention has been made to solve the above-described problem, and aims to improve the fitting performance of the cover of the connector when fitted to the housing.

(1) To solve the above-described problem, one aspect of the present invention provides a connector that is to be fitted to a partner connector, including: a housing that has an opening that opens in a direction that is opposite a fitting direction in which the connector is fitted to the partner connector; a cover that includes a first cover engagement part that engages with a housing engagement part that is formed on the housing, and is fixed to the housing so as to cover the opening; a slider that is housed within the housing, is provided so as to be slidable along the housing in a sliding direction that is a direction that intersects the fitting direction, and is configured to slide in the sliding direction so that the housing is fitted to the partner connector; an operation-target part configured to slide the slider upon being operated; and a lock mechanism that includes a slider engagement part that is formed on the slider, and a second cover engagement part that is formed on the cover, and is configured such that the slide engagement part engages with the second cover engagement part in a situation where fitting of the housing and the partner connector to each other is complete, so that the cover is prevented from being separated from the slider.

With this configuration, the first cover engagement part engages with the housing engagement part, and thus the cover is fixed to the housing so as to cover the opening of the housing. Also, with this configuration, the slider housed within the housing slides upon the operation-target part being operated by a user. Thus, the housing of the connector can be fitted to the partner connector.

With this configuration, in a situation where the housing of the connector is fitted to the partner connector, the slider engagement part engages with the second cover engagement part. Consequently, this configuration prevents the cover from being separated from the slider housed within the housing, i.e., from the housing.

Therefore, this configuration improves the fitting performance of the cover when fitted to the housing.

(2) Preferably, the second cover engagement part has a first surface part on which a first surface is formed, the first surface extending in a direction that is orthogonal to the fitting direction, and the slider engagement part has a second surface part on which a second surface is formed and that is located in a direction that is opposite the fitting direction, relative to the first surface part, the second surface extending in a direction that is orthogonal to the fitting direction, and facing the first surface part in a situation where fitting of the housing and the partner connector to each other is complete.

With this configuration, even if a force is applied to the cover in a direction that is opposite the fitting direction, the first surface of the second cover engagement part abuts against the second surface of the slider engagement part, and the cover cannot be moved further in the direction that is opposite the fitting direction. Therefore, it is possible to appropriately prevent the cover from being separated from the housing.

(3) Further preferably, the first surface part is provided in a plurality, and the second surface part is provided in a plurality such that the plurality of second surface parts respectively engage with the plurality of first surface parts.

With this configuration, the plurality of first surface parts respectively engage with the plurality of second surface parts, and thus it is possible to further improve the fitting performance of the cover when fitted to the housing.

(4) Preferably, the second surface part is formed on a portion of the slider, the portion being located on the cover side.

With this configuration, the second surface of the slider engagement part is formed on a portion of the slider, the portion being located on the cover side, and therefore it is unnecessary to form the second cover engagement part so as to extend toward the slider by a large distance. In other words, with this configuration, it is possible to downsize the cover.

(5) To solve the above-described problem, an electrical connection device according to one aspect of the present invention includes one of the above-described connectors and a partner connector that is fitted to the connector.

With this configuration, it is possible to provide an electrical connection device that includes a connector in which the fitting performance of the cover when fitted to the housing is high.

It should be noted that the forgoing and other objects, features, and advantages of the invention will become apparent upon reading the following description with reference to the accompanying drawings.

DETAILED DESCRIPTION OF THE INVENTION

The following describes an embodiment of the present invention with reference to the drawings. The present invention is broadly applicable to connectors and electrical connection devices.

Figure 1:
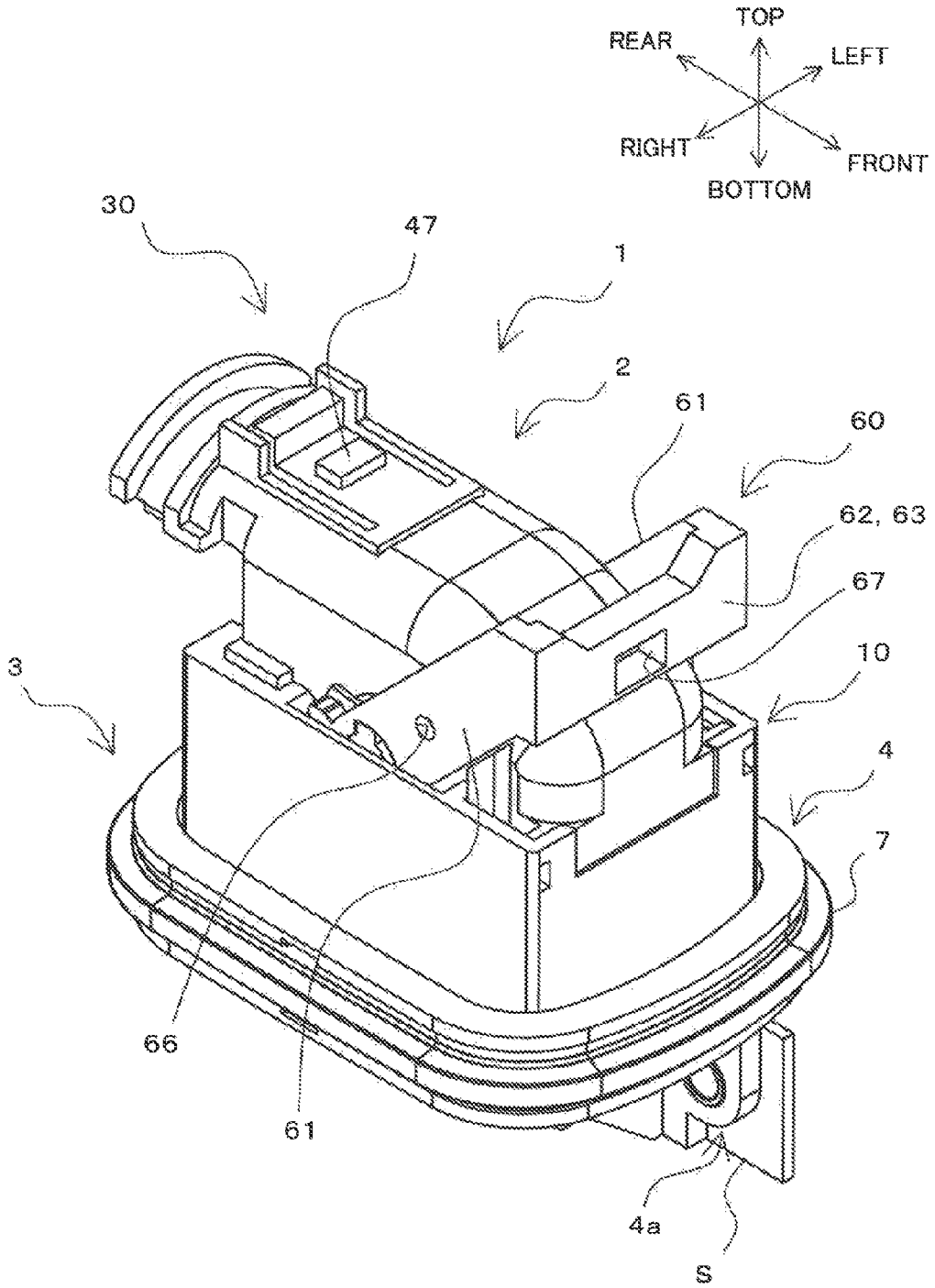
FIG. 1 is a perspective view showing an electrical connection device according to an embodiment, and showing a situation where a connector is placed on a partner connector, and the connectors are yet to be fitted to each other.
Figure 2:
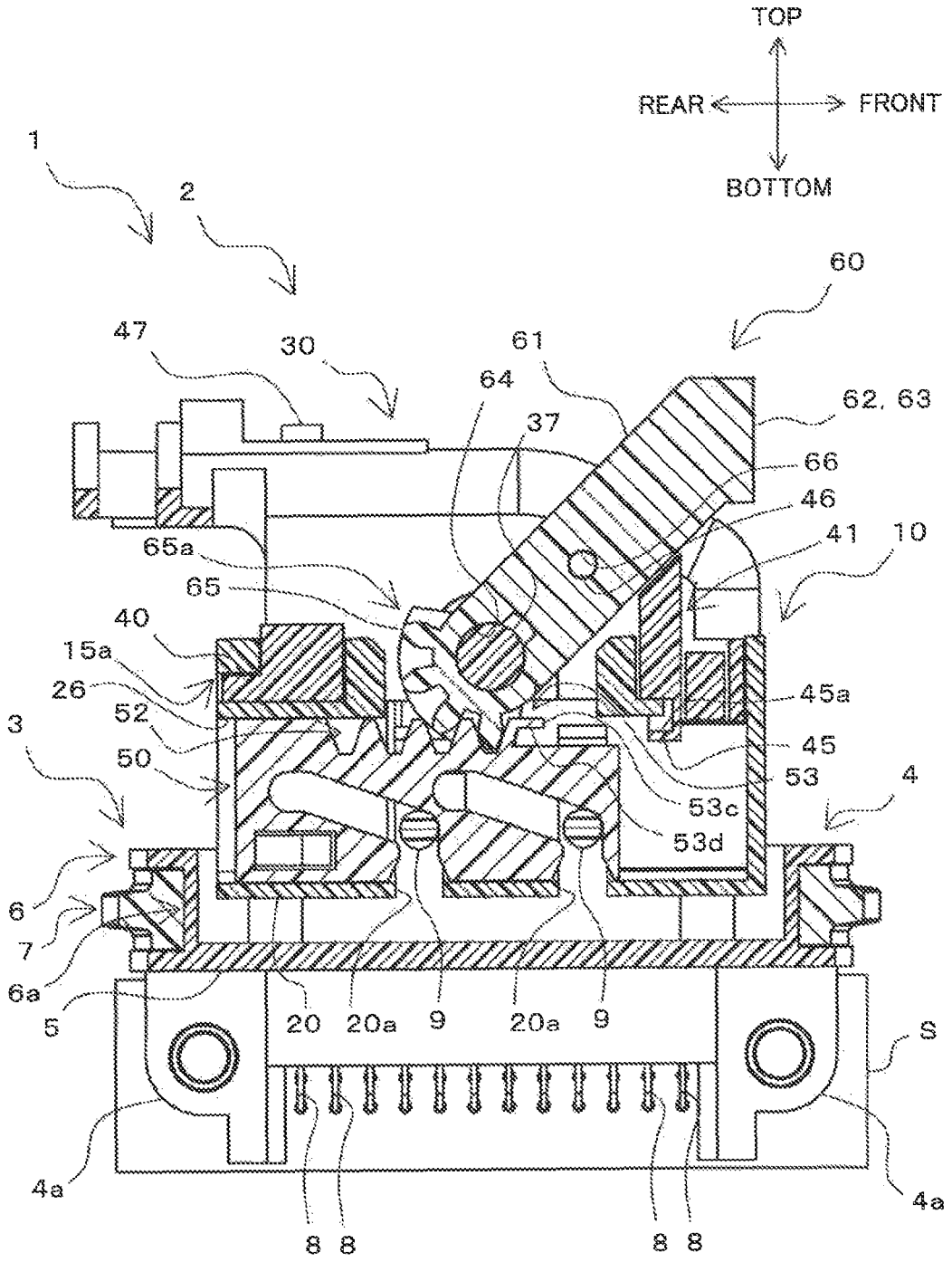
FIG. 2 is a cross-sectional view showing the connector and the partner connector in the situation shown in FIG. 1.
Figure 3:
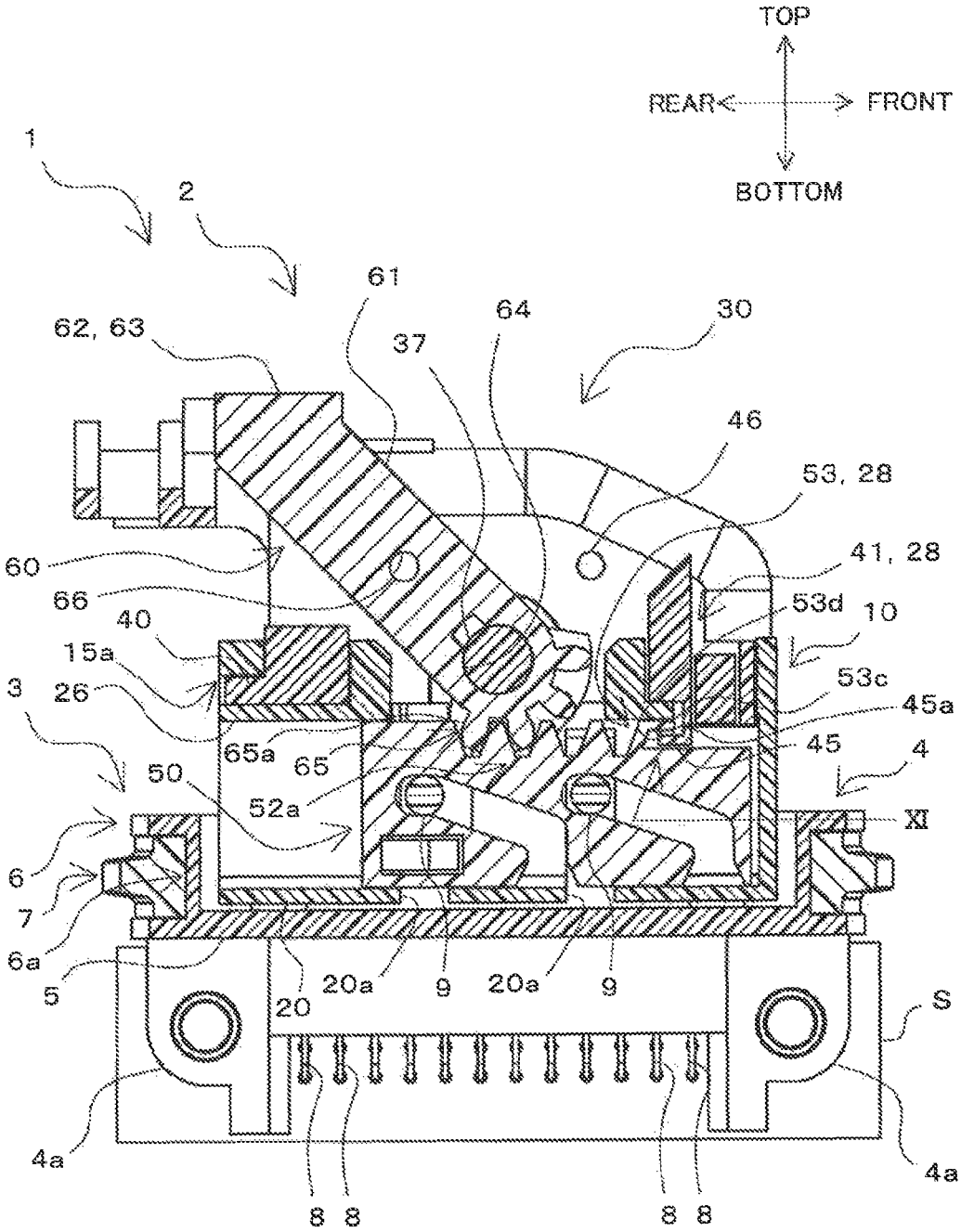
FIG. 3 is a cross-sectional view showing a situation where a lever of the connector of the electrical connection device has been operated and thus the connector and the partner connector are fitted to each other, and is a diagram corresponding to FIG. 2.

FIG. 1 is a perspective view showing an electrical connection device 1 according to the present embodiment, and showing a situation where a connector 2 is placed on a partner connector 3 and the connectors are yet to be fitted to each other. FIG. 2 is a cross-sectional view showing the connector 2 and the partner connector 3 in the situation shown in FIG. 1. FIG. 3 is a cross-sectional view showing a situation where a lever 60 of the connector 2 of the electrical connection device 1 has been operated and thus the connector 1 and the partner connector 3 are fitted to each other, and is a diagram corresponding to FIG. 2.

In the drawings, for convenience of description, the direction indicated by the arrow denoted by "RIGHT" is referred to as "the right side", the direction indicated by the arrow denoted by "LEFT" is referred to as "the left side", the direction indicated by the arrow denoted by "TOP" is referred to as "the top side" or "upward", the direction indicated by the arrow denoted by "BOTTOM" is referred to as "the bottom side" or "downward", the direction indicated by the arrow denoted by "FRONT" is referred to as "the front side" or "forward", and the direction indicated by the arrow denoted by "REAR" is referred to as "the rear side" or "rearward". Note that "downward" is a direction in which the connector 2 is fitted to the partner connector 3 (a fitting direction), and "upward" is a direction in which the connector 2 is removed from the partner connector 3 (a removal direction).

The electrical connection device 1 according to the present embodiment is configured such that it is easy to insert and fit the connector 2 into the partner connector 3 by tilting the lever 60 included in the connector 2 rearward (see FIG. 3) in a situation where the connector 2 is placed on the partner connector 3 (see FIG. 1 and FIG. 2).

Overall Configuration of Partner Connector

The partner connector 3 is a connector that is fixed to a chassis (not shown), and is a connector that is to be fitted to the connector 2. As shown in FIGS. 1 to 3, the partner connector 3 includes a partner housing 4, a seal ring 7, and a plurality of male contacts 8.

The partner housing 4 is a member that is formed in a substantially disc-like thin shape that extends in the top-bottom direction. As shown in FIGS. 2 and 3, the partner housing 4 includes: a bottom part 5 that extends in the front-rear direction and the left-right direction and has a predetermined thickness in the top-bottom direction; and a peripheral wall part 6 that extends upward from an outer peripheral portion of the bottom part 5. An attachment part 4*a* of the partner housing 4 is fixed to a substrate S that is provided in the chassis, and thus the partner housing 4 is fixed to the substrate S.

In a situation where the connector 2 and the partner connector 3 are fitted to each other, a lower end portion of the connector 2 is housed within a space that is surrounded by the bottom part 5 and the peripheral wall part 6 of the partner housing 4. A plurality of through holes (not shown) that penetrate through the bottom part 5 in the top-bottom direction are provided in the bottom part 5. The male contacts 8 are inserted into these through holes. A ring-like groove 6*a* that is formed in a ring shape is formed on the outside of the peripheral wall part 6. The seal ring 7 is fitted into the ring-like groove 6*a*.

The seal ring 7 is a member that is formed in a ring shape and that is elastic. The seal ring 7 is fitted into the ring-like groove 6*a* that is formed in the partner housing 4. The seal ring 7 seals a gap between the partner housing 4 and the chassis in a situation where the partner connector 3 is fixed to the chassis. This configuration improves the waterproof properties of the electrical connection device 1.

Each of the male contacts 8 is formed by bending an electrically-conductive rod-like metal member into an L-like shape. One end (the base end) of each male contact 8 is soldered to the substrate S that is provided in the chassis. In contrast, the other end (the tip end) of each male contact 8 is exposed upward through a through hole that is formed in the bottom part 5 of the partner housing 4. The male contacts 8 are fitted into female contacts (not shown) of the connector 2 in a situation where the connector 2 and the partner connector 3 are fitted to each other.

Overall Configuration of Connector

As shown in FIGS. 1 to 3, the connector 2 includes: a housing 10; a cover 30; a pair of sliders 50 and 59 (FIGS. 2 and 3 only show the right-side slider 50); the lever 60; a plurality of female contacts (not shown); and a retainer (not shown) that prevents the plurality of female contacts from being removed from the housing 10.

Figure 4:
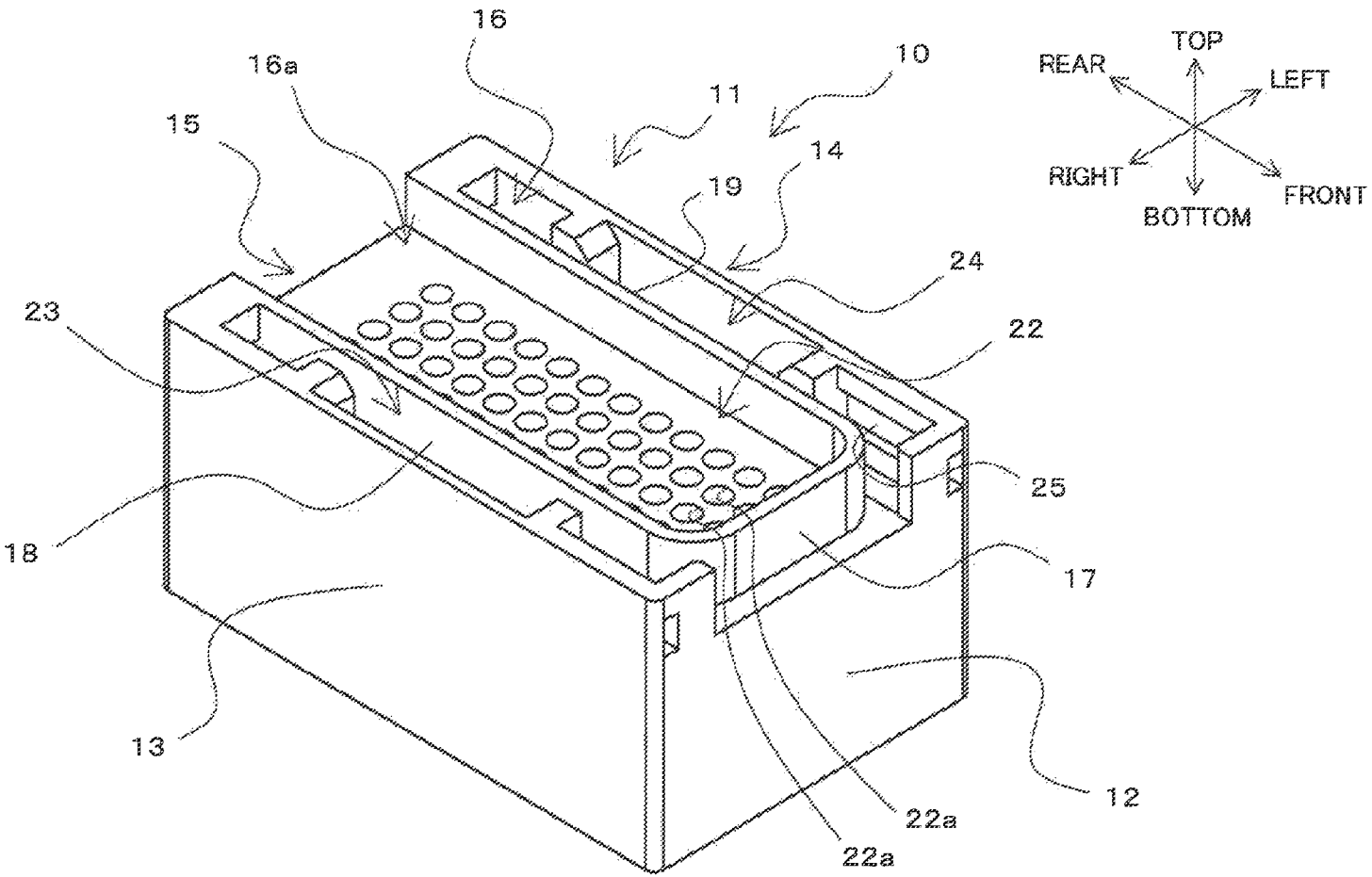
FIG. 4 is a perspective view of a housing that is shown in FIG. 1, when viewed from a front side.
Figure 5:
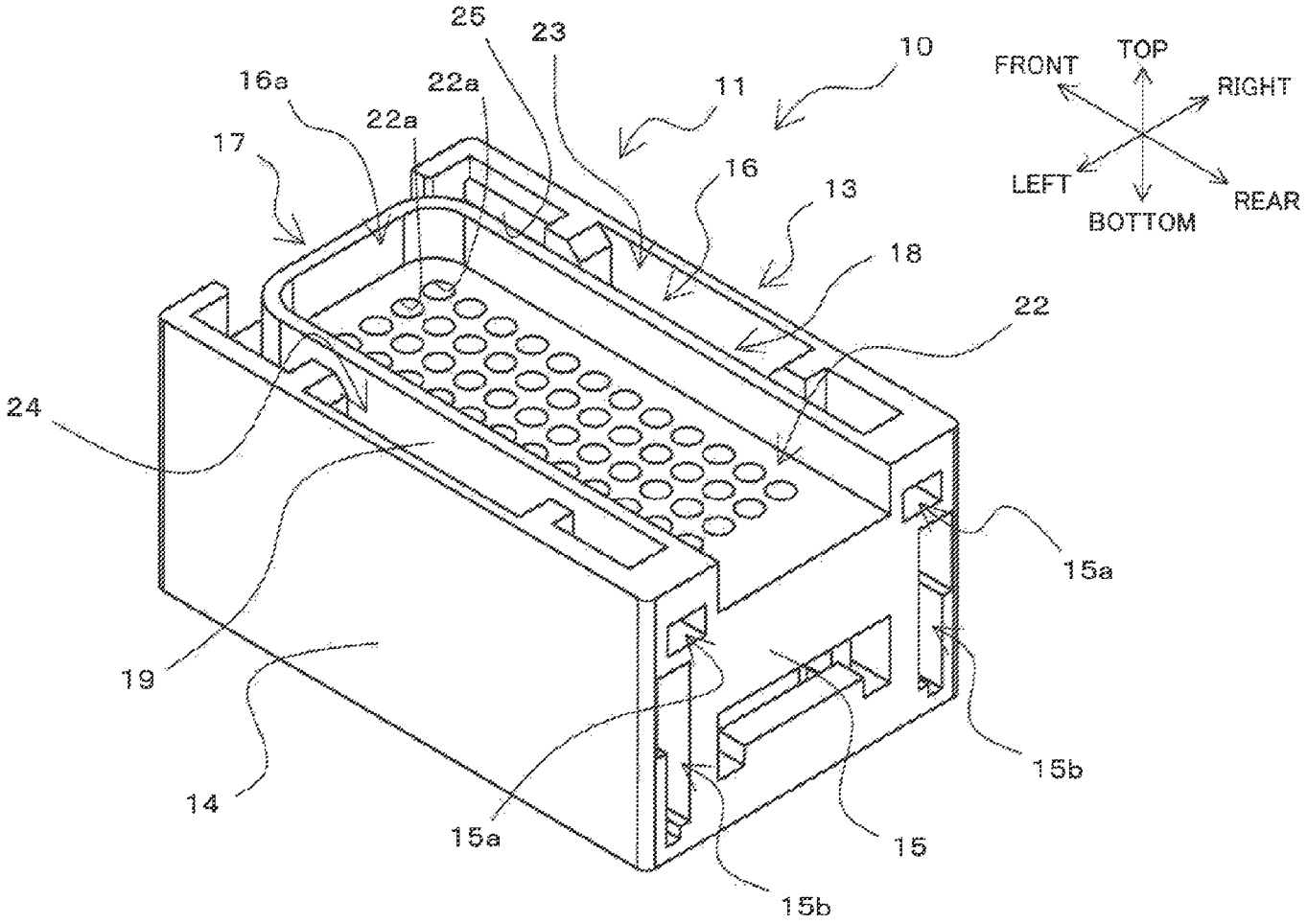
FIG. 5 is a perspective view of the housing that is shown in FIG. 4, when viewed from a rear side.
Figure 6:
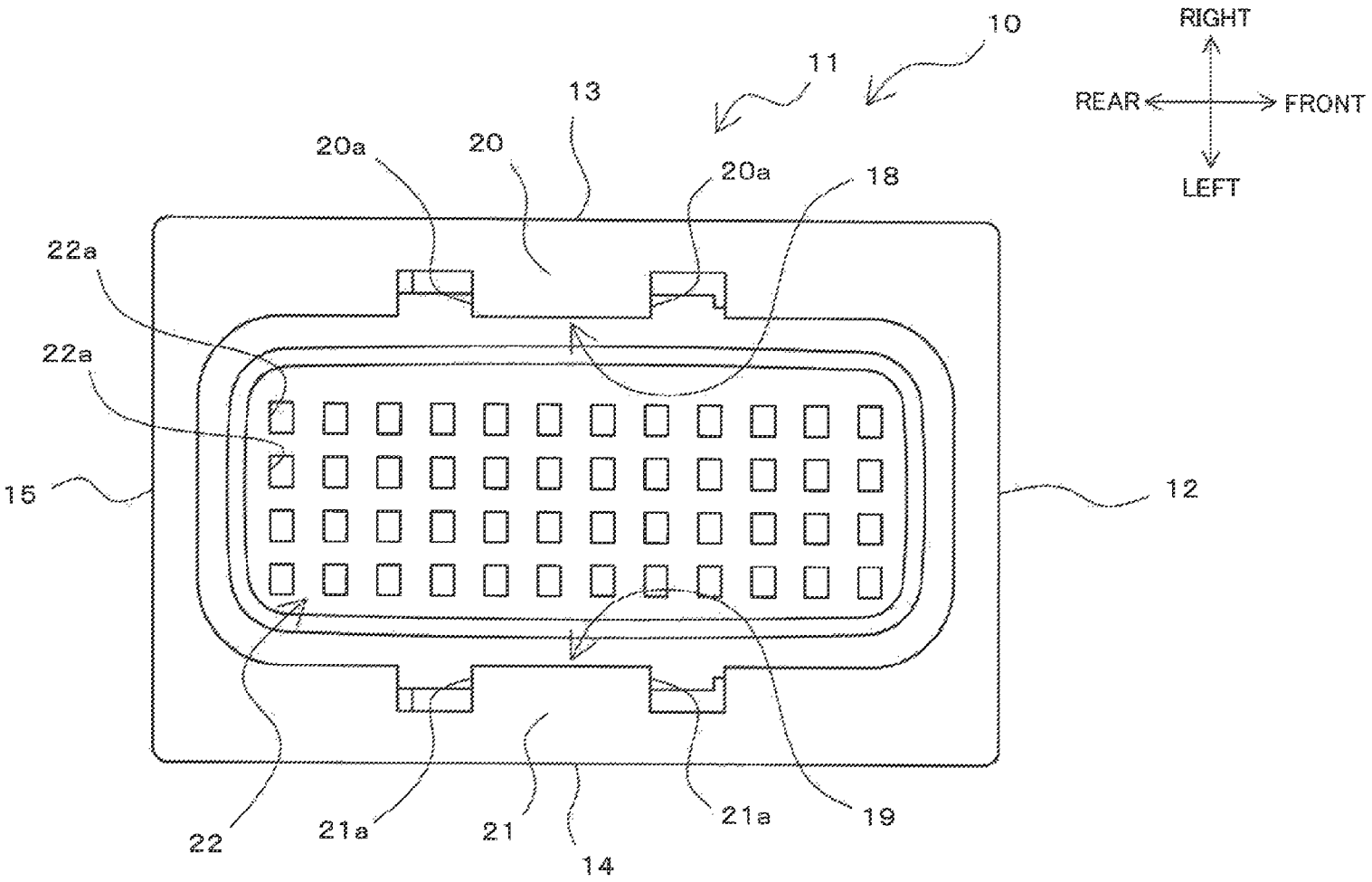
FIG. 6 is a bottom view of the housing shown in FIG. 4.

FIG. 4 is a perspective view of the housing 10 shown in FIG. 1, viewed from the front side. FIG. 5 is a perspective view of the housing 10 shown in FIG. 4, when viewed from the rear side. FIG. 6 is a bottom view of the housing 10 shown in FIG. 4.

The housing 10 is formed in a substantially box-like shape and houses the plurality of female contacts (not shown) and the pair of sliders 50 and 59. The housing 10 includes an outer wall part 11, an inner wall part 16, a right-side bottom wall part 20, a left-side bottom wall part 21, and a female contact housing part 22, which are integrated into once piece.

The outer wall part 11 is a wall-like part that is provided as the outermost portion of the housing 10. The outer wall part 11 includes an outer front wall part 12, an outer right wall part 13, an outer left wall part 14, and an outer rear wall part 15, which are integrated into one piece.

As shown in FIGS. 2, 3, and 5, left and right end portions of an upper portion of the outer rear wall part 15 are respectively provided with an engagement hole 15*a* (a housing engagement part) that is a through hole penetrating through the outer rear wall part 15 in the front-rear direction. First claw parts 40 of the cover 30 that will be described in detail below engage with the engagement holes 15*a*.

Also, as shown in FIG. 5, left and right end portions of the outer rear wall part 15 are each provided with an elongated through hole 15*b* that is elongated in the top-bottom direction and penetrates through the outer rear wall part 15 in the front-rear direction. When the connector 2 is to be attached, the sliders 50 and 59 that will be described in detail below are inserted into the elongated through holes 15*b*, and are housed in slider housing parts 23 and 24 in the housing 10.

The inner wall part 16 is a wall-like part that is formed slightly inward of the outer wall part 11, and is formed so as to have a substantially U-like shape when viewed from above. In this way, due to the presence of the inner wall part 16 formed in a substantially U-like shape, the portion surrounded by the inner wall part 16 is provided as an opening 16*a* that is open upward. The inner wall part 16 includes an inner front wall part 17, an inner right wall part 18, and an inner left wall part 19, which are integrated into one piece. In the inner wall part 16, the inner front wall part 17 is provided integrally with the outer front wall part 12, and a rear end portion of the inner right wall part 18 and a rear end portion of the inner left wall part 19 are provided integrally with the outer rear wall part 15.

As shown in FIG. 6, the right-side bottom wall part 20 is a wall-like part that couples a lower end portion of the outer right wall part 13 and a lower end portion of the inner right wall part 18 to each other. Cutout portions 20*a* that are cut out from the bottom side to the top side are formed in the right-side bottom wall part 20. Two cutout portions 20*a* are formed, with an interval being provided therebetween in the front-rear direction. When the connector 2 is to be fitted to the partner connector 3, right-side protrusions 9 (see FIGS. 2 and 3) that are formed on the partner housing 4 of the partner connector 3 are inserted into the cutout portions 20*a*. Note that two right-side protrusions 9 are formed on a right-side portion of the partner housing 4, with an interval being provided therebetween in the front-rear direction.

As shown in FIG. 6, the left-side bottom wall part 21 is a wall-like part that couples a lower end portion of the outer left wall part 14 and a lower end portion of the inner left wall part 19 to each other. Cutout portions 21*a* that are cut out from the bottom side to the top side are formed in the left-side bottom wall part 21 in the same manner as in the case of the right-side bottom wall part 20. Two cutout portions 21*a* are formed, with an interval being provided therebetween in the front-rear direction. When the connector 2 is to be fitted to the partner connector 3, left-side protrusions (not shown) that are formed on the partner housing 4 of the partner connector 3 are inserted into the cutout portions 21*a*. Note that two left-side protrusions are formed on a left-side portion of the partner housing 4, with an interval being provided therebetween in the front-rear direction.

The female contact housing part 22 is a part that is provided on a central portion of the housing 10 in the left-right direction, and has a predetermined thickness in the top-bottom direction. A plurality of through holes 22*a* that penetrate through the female contact housing part 22 in the top-bottom direction are formed in the female contact housing part 22. The female contacts (not shown) that are fitted onto the male contacts 8 of the partner connector 3 are housed within the through holes 22*a*. Although not shown in the drawings, end portions of cables are mechanically and electrically connected to the female contacts through swaging, soldering, or the like. Each of the cables extends to the outside via the opening 16*a* of the housing 10 and the internal space of the cover 30 that will be described below.

As shown in FIGS. 4 and 5, the housing 10 includes the right-side slider housing part 23 and the left-side slider housing part 24.

The right-side slider housing part 23 is a part that is provided as a right-side portion of the housing 10, and is configured to house the right-side slider 50. The right-side slider housing part 23 includes the outer right wall part 13, the inner right wall part 18, and the right-side bottom wall part 20 described above, and the right-side slider 50 is housed within a space that is surrounded by these wall parts.

The left-side slider housing part 24 is a part that is provided as a left-side portion of the housing 10, and is configured to house the left-side slider 59. The left-side slider housing part 24 includes the outer left wall part 14, the inner left wall part 19, and the left-side bottom wall part 21 described above, and the left-side slider 59 is housed within a space surrounded by these wall parts.

Figure 7:
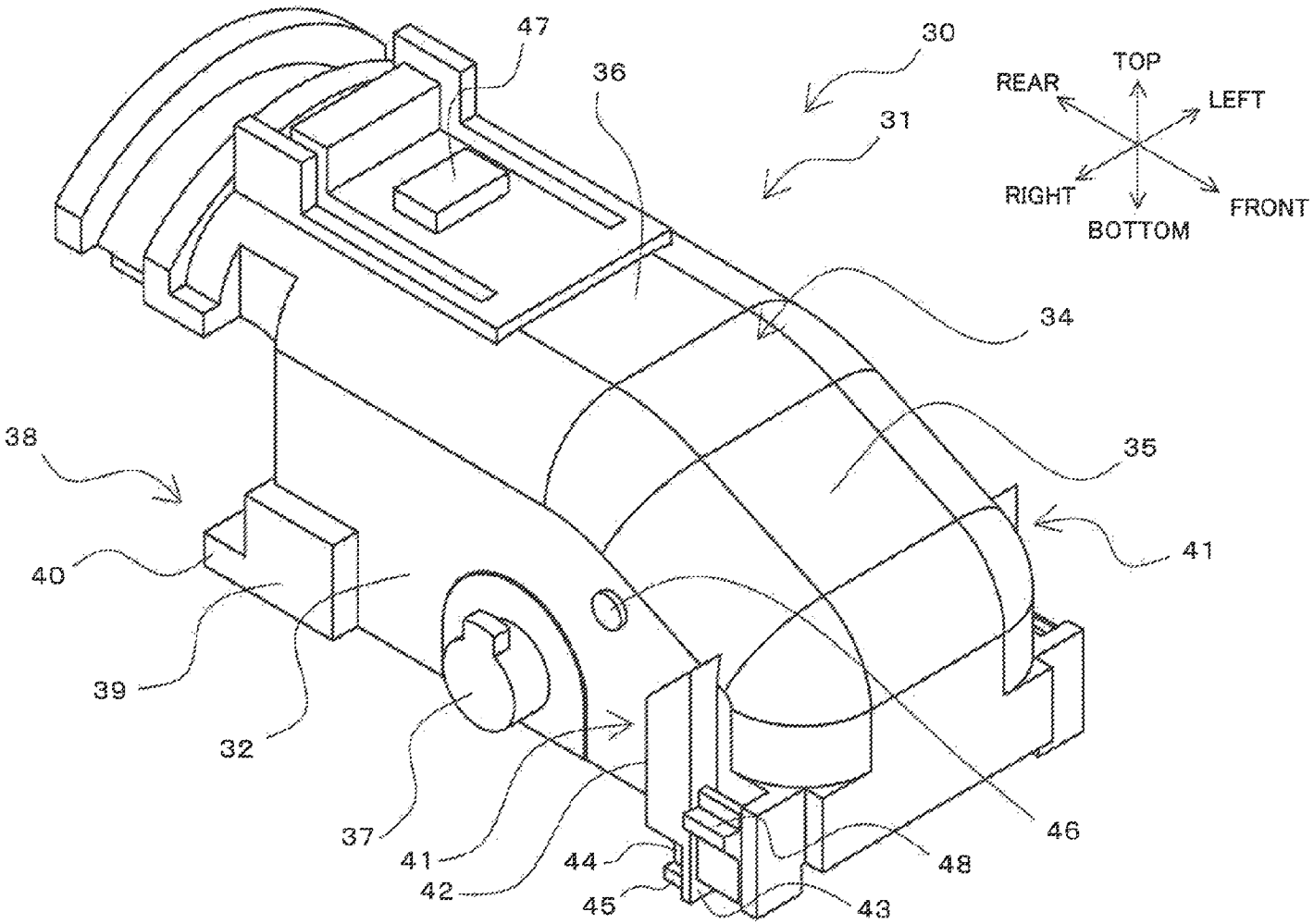
FIG. 7 is a perspective view of a cover that is shown in FIG. 1, when viewed from the front side.
Figure 8:
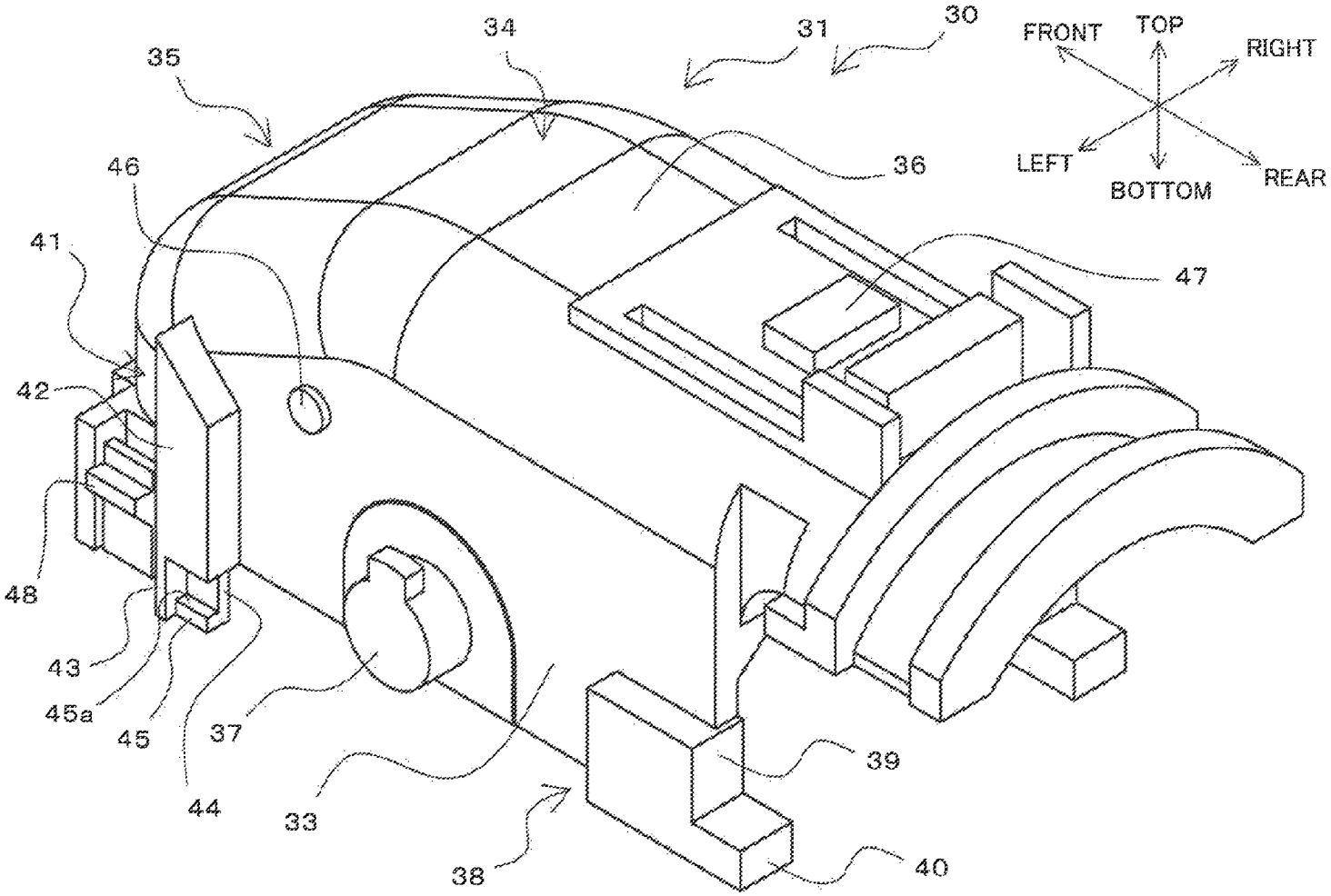
FIG. 8 is a perspective view of the cover that is shown in FIG. 7, when viewed from the rear side.

FIG. 7 is a perspective view of the cover 30 shown in FIG. 1, when viewed from the front side. FIG. 8 is a perspective view of the cover 30 shown in FIG. 7, when viewed from the rear side. The cover 30, when fixed to the housing 10, covers the opening 16*a* of the housing 10.

The cover 30 includes a cover main body 31, pivots 37, first cover engagement parts 38, and second cover engagement parts 41, which are integrated into one piece.

The cover main body 31 is a part that is formed so as to have a substantially dome-like shape in which a space is provided. The cover main body 31 includes a right wall part 32, a left wall part 33, and a cover part 34, which are integrated into one piece.

The right wall part 32 is a wall-like part that is provided as a right-side portion of the cover main body 31, and has a predetermined thickness in the left-right direction.

The left wall part 33 is a wall-like part that is provided as a left-side portion of the cover main body 31, and has a predetermined thickness in the left-right direction.

The cover part 34 is a part that is provided above the right wall part 32 and the left wall part 33, and is integrated with the right wall part 32 and the left wall part 33 into one piece. The cover part 34 includes an inclined part 35 that is inclined upward while extending rearward from the front side, and an extension part 36 that extends rearward from a rear end portion of the inclined part 35. A portion of the cover part 34 that is connected to the right wall part 32 and the left wall part 33 is formed so as to be curved.

The pivots 37 are respectively formed on the right wall part 32 and the left wall part 33. Each of the pivots 37 is formed in a substantially columnar shape that protrudes outward from the wall part 32 or 33. The pivots 37 are inserted into pivot holes 64 of the lever 60 that will be described in detail below.

The first cover engagement parts 38 are respectively formed on a lower portion of a rear end portion of the right wall part 32 and a lower portion of a rear end portion of the left wall part 33. The first cover engagement parts 38 are parts for fixing the cover 30 to the housing 10. Each of the first cover engagement parts 38 includes a cuboid part 39 that is formed in a cuboid shape, and a first claw part 40 that protrudes rearward from the cuboid part 39.

The thickness of the cuboid parts 39 in the left-right direction is slightly greater than the thickness of the wall parts 32 and 33. The cuboid parts 39 are formed so as to bulge slightly outward from the wall parts 32 and 33.

The first claw parts 40 are each formed in a cuboid shape and protrude rearward from rear surfaces of the cuboid parts 39.

The second cover engagement parts 41 are respectively formed on front end portions of the right wall part 32 and the left wall part 33 so as to extend in the top-bottom direction. The second cover engagement parts 41 constitute a lock mechanism 28 together with slider engagement parts 53 that will be described in detail below. The lock mechanism 28 is a mechanism for preventing the cover 30 from being separated from the sliders 50 and 59. Each of the second cover engagement parts 41 includes an elongated protrusion 42 that extends in the top-bottom direction, a first extension part 43, a second extension part 44, and a second claw part 45 (a first surface part), which are integrated into one piece.

The elongated protrusions 42 are elongated protruding parts that respectively extend downward from upper portions of front end portions of the wall parts 32 and 33. The elongated protrusions 42 extend from the top side to the lower ends of the wall parts 32 and 33.

The first extension parts 43 are formed so as to respectively extend downward from front portions of lower end surfaces of the elongated protrusions 42.

The second extension parts 44 are formed so as to respectively extend downward from inner portions of the lower end surfaces of the elongated protrusions 42. The second extension parts 44 respectively extend to tip end portions of the first extension parts 43. The second extension parts 44 are respectively integrated with the first extension parts 43.

The second claw parts 45 are each formed in a small cuboid shape and respectively protrude slightly outward from outer portions of the tip end portions of the second extension parts 44. The upper surfaces of the second claw parts 45 are each provided as a first surface 45*a* that is formed as a flat surface.

In the connector 2, the cover 30 engages with the housing 10 in the following manner. Specifically, as shown in FIGS. 2 and 3, in a rear portion of the connector 2, the first claw parts 40 of the cover 30 are inserted into the engagement holes 15*a* of the housing 10. In a front portion of the connector 2, third claw parts 48 (see FIGS. 7 and 8) of the cover 30 are fitted into groove parts 25 (see FIGS. 4 and 5) that are formed in the housing 10. With this configuration, the front portions and the rear portions of the housing 10 and the cover 30 are fitted to each other, and the cover 30 is prevented from moving in a direction in which the cover 30 is detached from the housing 10 (an upward direction, the removal direction), and from being removed from the housing 10.

Figure 9:
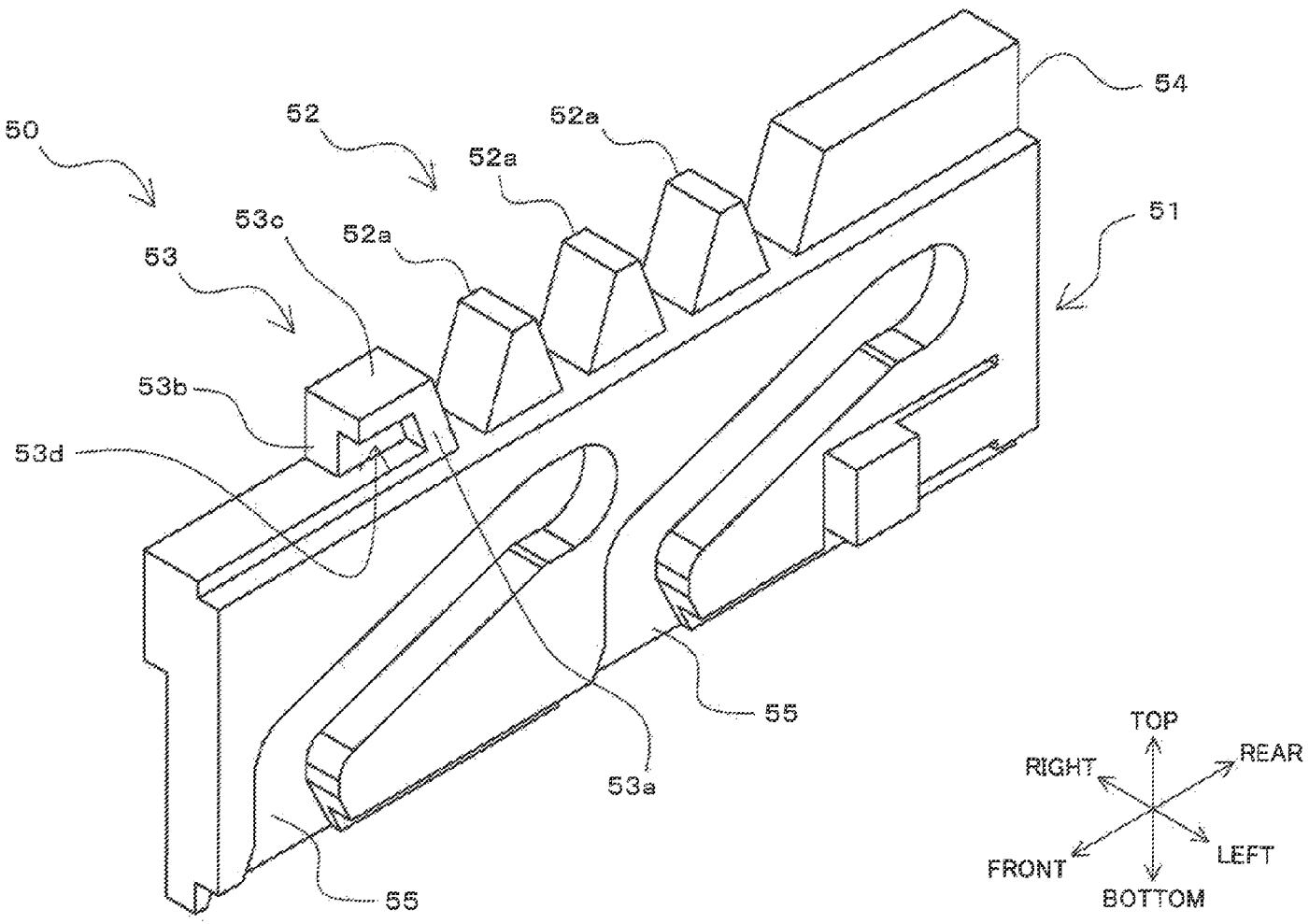
FIG. 9 is a perspective view of a right-side slider.
Figure 10:
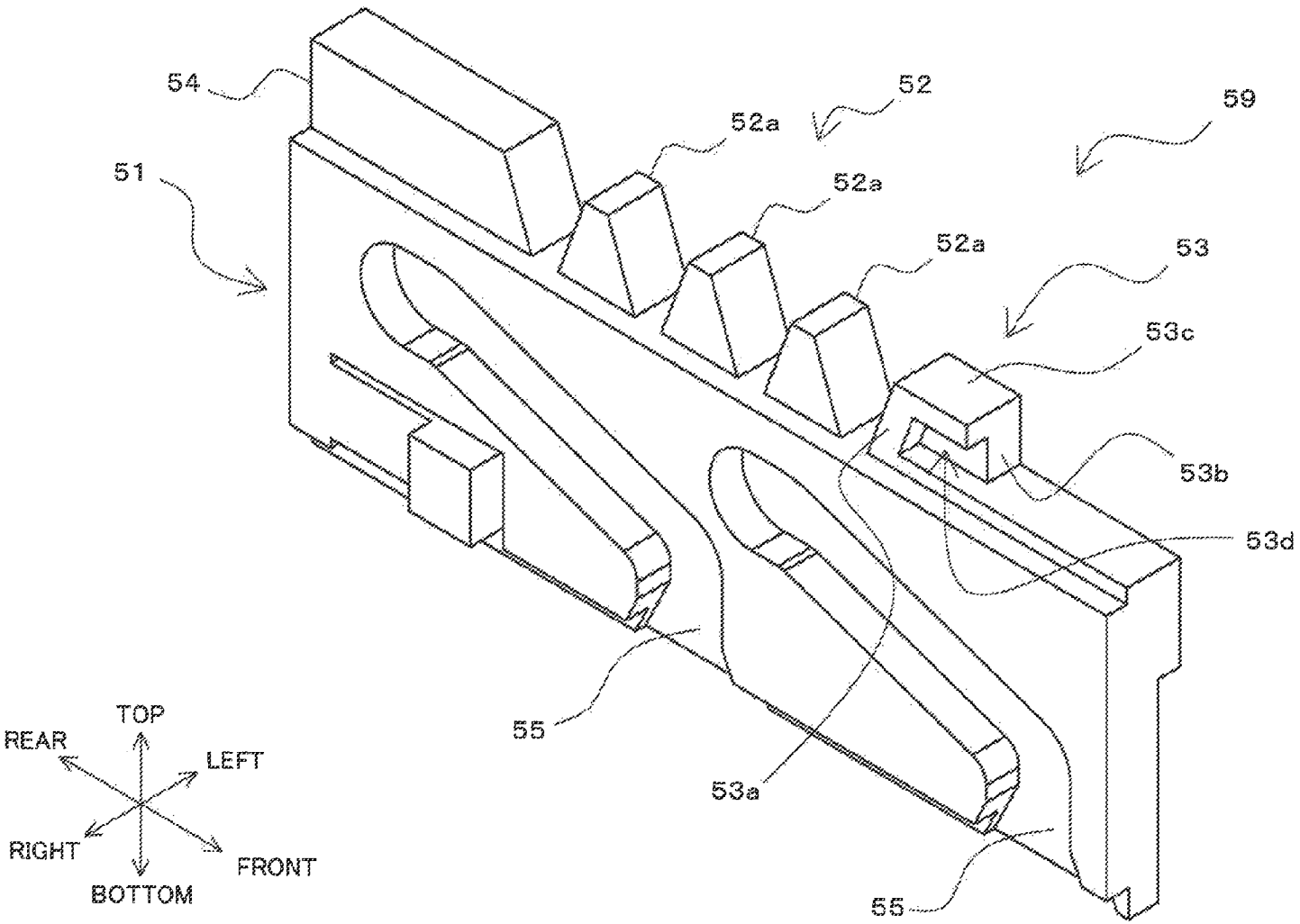
FIG. 10 is a perspective view of a left-side slider.

FIG. 9 is a perspective view of the right-side slider 50. FIG. 10 is a perspective view of the left-side slider 59. Each of the sliders 50 and 59 is a member that is formed in a substantially plate-like shape that is thin in the left-right direction, and is housed in the corresponding one of the slider housings 23 and 24.

As shown in FIG. 9, the right-side slider 50 includes a slider main body 51, a rack part 52, a slider engagement part 53, and an extension part 54.

The slider main body 51 is a plate-like part that has a predetermined thickness in the left-right direction, and is formed such that the length thereof in the front-rear direction is longer than the length thereof in the top-bottom direction.

Two cam grooves 55 are formed in the slider main body 51. The cam grooves 55 are formed in the inner surface of the slider main body 51 (the left-side surface in the case of the right-side slider 50) with an interval being provided therebetween in the front-rear direction. The cam grooves 55 are formed so as to extend upward by a certain distance from the lower end surface of the slider main body 51, and then gradually extend upward in the rearward direction.

The rack part 52 includes a plurality of rack teeth 52*a*. The rack part 52 is formed on the upper end surface of the slider main body 51. Pinion parts 65 of the lever 60 that will be described below engage with rack parts 52.

The extension part 54 is an elongated protruding part that is formed on the upper end surface of the slider main body 51, and is formed so as to extend from a portion that is slightly rearward of the rack part 52 to the rear end surface of the slider main body 51.

As shown in FIG. 3, the slider engagement part 53 is configured to engage with the corresponding second cover engagement part 41 of the cover 30 in a situation where the connector 2 and the partner connector 3 are fitted to each other. As shown in FIG. 9, the slider engagement part 53 includes a first extension part 53*a*, a second extension part 53*b*, and a flat surface part 53*c* (a second surface part), which are integrated into one piece.

The first extension part 53*a* is formed so as to extend from a portion that is slightly forward of the rack part 52, in an upward direction by a certain distance. The first extension part 53*a* is a flake-like part that has a thickness in the front-rear direction.

The second extension part 53*b* is formed so as to extend from a portion that is slightly forward of the rack part 52, in an upward direction by a certain distance, in the same manner as in the case of the first extension part 53*a*. The second extension part 53*b* is a flake-like part that has a thickness in the left-right direction, and a rear end portion thereof is integrated with an outer portion of the first extension part 53*a* (a right-side portion in the case of the right-side slider 50).

The flat surface part 53*c* is a flat part that covers, from above, a space that is surrounded by the first extension part 53*a* and the second extension part 53*b*. The flat surface part 53*c* is formed so as to have a rectangular shape when viewed from above, and has a predetermined thickness in the top-bottom direction. The lower surface of the flat surface part 53*c* is provided as a second surface 53*d* that is formed as a flat surface.

The left-side slider 59 includes, as with the right-side slider 50, a slider main body 51, a rack part 52, a slider engagement part 53, and an extension part 54. The left-side slider 59 has the same configuration as the right-side slider 50 except that the left-side slider 59 has a bilaterally symmetrical shape unlike the right-side slider 50, and therefore the configuration thereof is omitted.

The sliders 50 and 59 are housed within the housing 10 in the following manner, and are provided so as to be slidable in the front-rear direction relative to the housing 10. Specifically, the right-side slider 50 is sandwiched between the outer right wall part 13 and the inner right wall part 18 such that the left and right side surfaces of the right-side slider 50 are slidable along the outer right wall part 13 and the inner right wall part 18, and a lower end portion of the right-side slider 50 is placed on the right-side bottom wall part 20. In this situation, force is applied in the front-rear direction by using the lever 60 that will be described in detail below, and thus the right-side slider 50 slides in the front-rear direction. Note that, as shown in FIG. 2, the right-side slider 50 is sandwiched in the top-bottom direction between an upper wall part 26 and the right-side bottom wall part 20 that are formed in the housing 10, and is thus restricted from moving in the top-bottom direction.

The left-side slider 59 is sandwiched between the outer left wall part 14 and the inner left wall part 19 such that the left and right side surfaces of the left-side slider 59 are slidable along the outer left wall part 14 and the inner left wall part 19, and a lower end portion of the left-side slider 59 is placed on the left-side bottom wall part 21. In this situation, a force is applied in the front-rear direction by using the lever 60 that will be described in detail below, and thus the left-side slider 59 slides in the front-rear direction. Note that the left-side slider 59 is, as with the right-side slider 50, sandwiched in the top-bottom direction between the upper wall part 26 and the left-side bottom wall part 21, and is thus restricted from moving in the top-bottom direction.

As shown in FIGS. 1 to 3, the lever 60 includes: a pair of plate parts 61 and a coupling part 62 that couples end portions of the pair of plate parts 61 to each other; which are integrated into one piece. The coupling part 62 is provided as an operation-target part 63 that is to be operated by the user.

The plate parts 61 are parts that are each formed in a slightly elongated plate-like shape that has a predetermined thickness in the left-right direction. Tip end portions of the plate parts 61 (portions that are opposite the coupling part 62) are provided with circular through holes that penetrate through the portions in a thickness direction, and the pivots 37 of the cover 30 are inserted into the through holes. In other words, the through holes are formed as the pivot holes 64. With this configuration, the lever 60 is rotatable about the pivots 37 that extend in the left-right direction.

The pinion parts 65 that each have a plurality of pinion teeth 65*a* are formed on the tip end portions of the plate parts 61. The pinion parts 65 engage with the rack parts 52 that are formed in the sliders 50 and 59. With the connector 2, it is possible to slide the sliders 50 and 59 in the front-rear direction by operating the lever 60 in the front-rear direction.

Also, in a situation where the lever 60 is tilted to the frontmost side, protrusions 46 that are formed on the cover 30 are fitted into first holes 66 that are respectively formed in the plate parts 61. With this configuration, the lever 60 is restricted from being tilted further forward.

Also, in a situation where the lever 60 is tilted to the rearmost side, a protrusion 47 that is formed on the cover 30 is fitted into a second hole 67 (see FIG. 1) that is formed in the coupling part 62. With this configuration, the lever 60 is restricted from being tilted further rearward.

Operations of Connector and Partner Connector when Fitted to Each Other

In the electrical connection device 1 according to the present embodiment, when the connector 2 is to be connected to the partner connector 3, first, the connector 2 is placed on the partner connector 3. Specifically, as shown in FIG. 2, the connector 2 is placed on the partner connector 3 such that the right-side protrusions 9 that are formed on the partner housing 4 are inserted into the cutout portions 20*a* formed in the housing 10 of the connector 2, and, although omitted from FIG. 2, the left-side protrusions are inserted into the cutout portions 21*a*. Thus, the connector 2 is positioned in terms of the front-rear and left-right directions relative to the partner connector 3.

Next, in the electrical connection device 1, the lever 60 is rotated toward the rear side by the user. Accordingly, the pinion parts 65 that are formed on the lever 60 move the rack parts 52 of the sliders 50 and 59 forward. Consequently, the sliders 50 and 59 move forward, and accordingly the protrusions 9 of the partner connector 3 move upward along the cam grooves 55. As a result, the connector 2 is pressed toward the partner connector 3, and the male contacts 8 of the partner connector 3 are inserted into the female contacts of the connector 2. Thus, fitting of the connector 2 and the partner connector 3 to each other is complete (see FIG. 3).

Figure 11:
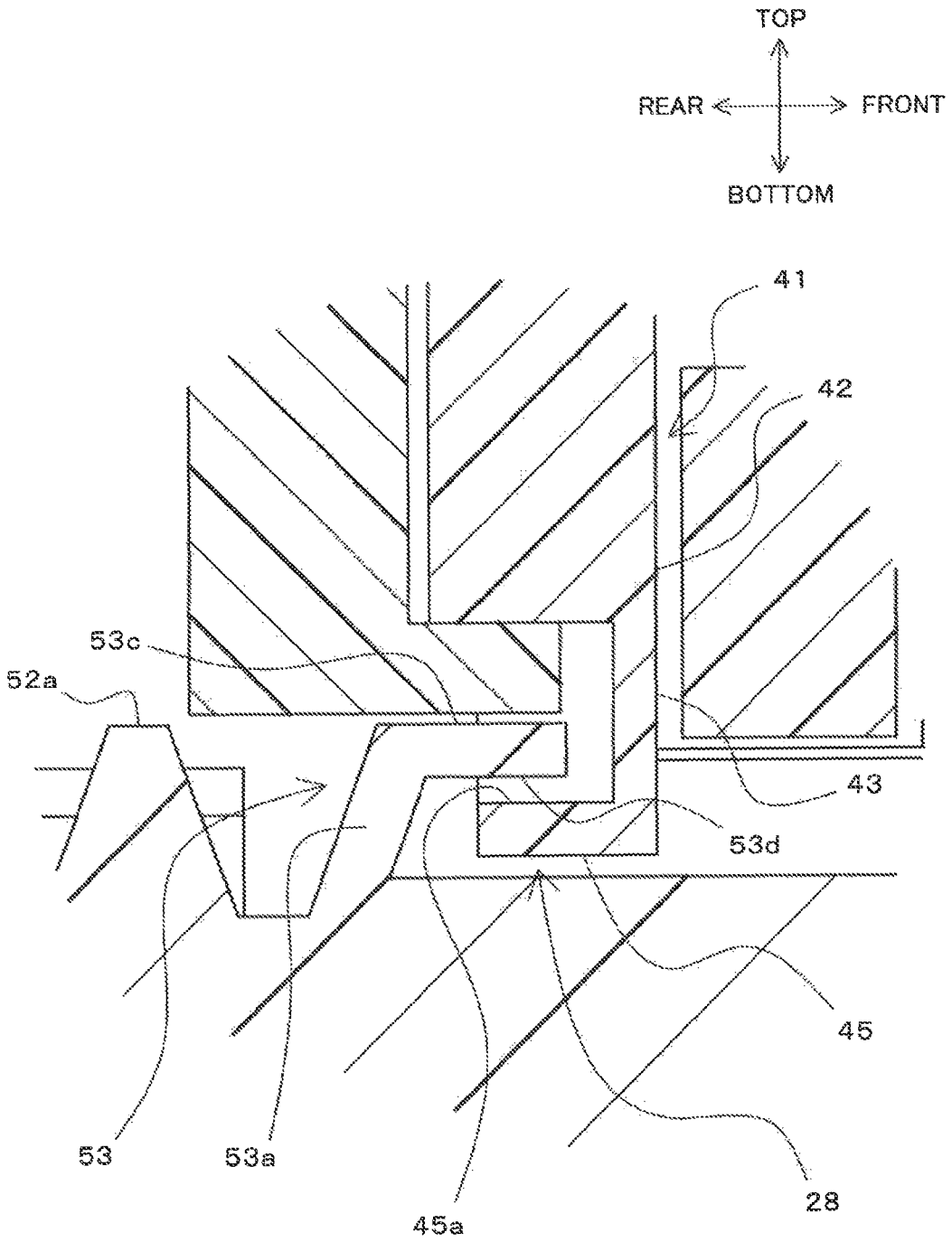
FIG. 11 is an enlarged view of a portion indicated by an arrow XI shown in FIG. 3.

FIG. 11 is an enlarged view of a portion indicated by an arrow XI that is shown in FIG. 3. As shown in FIG. 11, in a situation where fitting of the connector 2 and the partner connector 3 to each other has been completed as described above, the slider engagement parts 53 that are formed in the sliders 50 and 59 engage with the second cover engagement parts 41 that are formed in the cover 30. More specifically, as shown in FIG. 11, the second surfaces 53*d* of the slider engagement parts 53 face the first surfaces 45*a* of the second cover engagement parts 41, with a certain gap being provided in the top-bottom direction. With this configuration, for example, in the case where the engagement of the cover 30 with the housing 10 is released for a certain reason (more specifically, the engagement holes 15*a* are broken and the third claw parts 48 become separated from the groove parts 25), the cover 30 does not become separated from the housing 10 even if a force is applied to the cover 30 in the upward direction. Specifically, due to the presence of the second surfaces 53*d* of the sliders 50 and 59 that are restricted from moving in the top-bottom direction within the housing 10, the first surfaces 45*a* of the second cover engagement parts 41 are restricted from moving upward, and thus the cover 30 is prevented from being separated from the housing 10.

Effects

As described above, in the connector 2 of the electrical connection device 1 according to the present embodiment, the first cover engagement parts 38 engage with the engagement holes 15*a*, and thus the cover 30 is fixed to the housing 10 such that the cover 30 covers the opening 16*a* of the housing 10. Also, in the connector 2, the sliders 50 and 59 that are housed within the housing 10 slide upon the lever 60 being operated by the user. Thus, the housing 10 of the connector 2 can be fitted to the partner connector 3.

In the connector 2, in a situation where the housing 10 of the connector 2 is fitted to the partner connector 3, the slider engagement parts 53 engage with the second cover engagement parts 41. This configuration prevents the cover 30 from being separated from the sliders 50 and 59 that are housed within the housing 10, i.e., from the housing 10.

Therefore, with the connector 2, the fitting performance of the cover 30 when fitted to the housing 10 is improved.

Also, in the connector 2, even if a force is applied to the cover 30 in a direction that is opposite the fitting direction, the first surfaces 45*a* of the second cover engagement parts 41 abut against the second surfaces 53*d* of the slider engagement parts 53, and the cover 30 cannot be moved further in the direction that is opposite the fitting direction. Therefore, it is possible to appropriately prevent the cover 30 from being separated from the housing 10.

Also, in the connector 2, the second surfaces 53*d* of the slider engagement parts 53 are formed on portions of the sliders 50 and 59, the portions being located on the cover 30 side, and therefore it is unnecessary to form the second cover engagement parts 41 so as to extend toward the sliders 50 and 59 by a large distance. In other words, with the connector 2, it is possible to downsize the cover 30.

Also, the electrical connection device 1 according to the present embodiment provides an electrical connection device that includes the connector 2 in which the fitting performance of the cover 30 when fitted to the housing 10 is high.

Although an embodiment of the present invention has been described above, the present invention is not limited to the embodiment, and may be variously modified without departing from the spirit of the invention.

Figure 12:
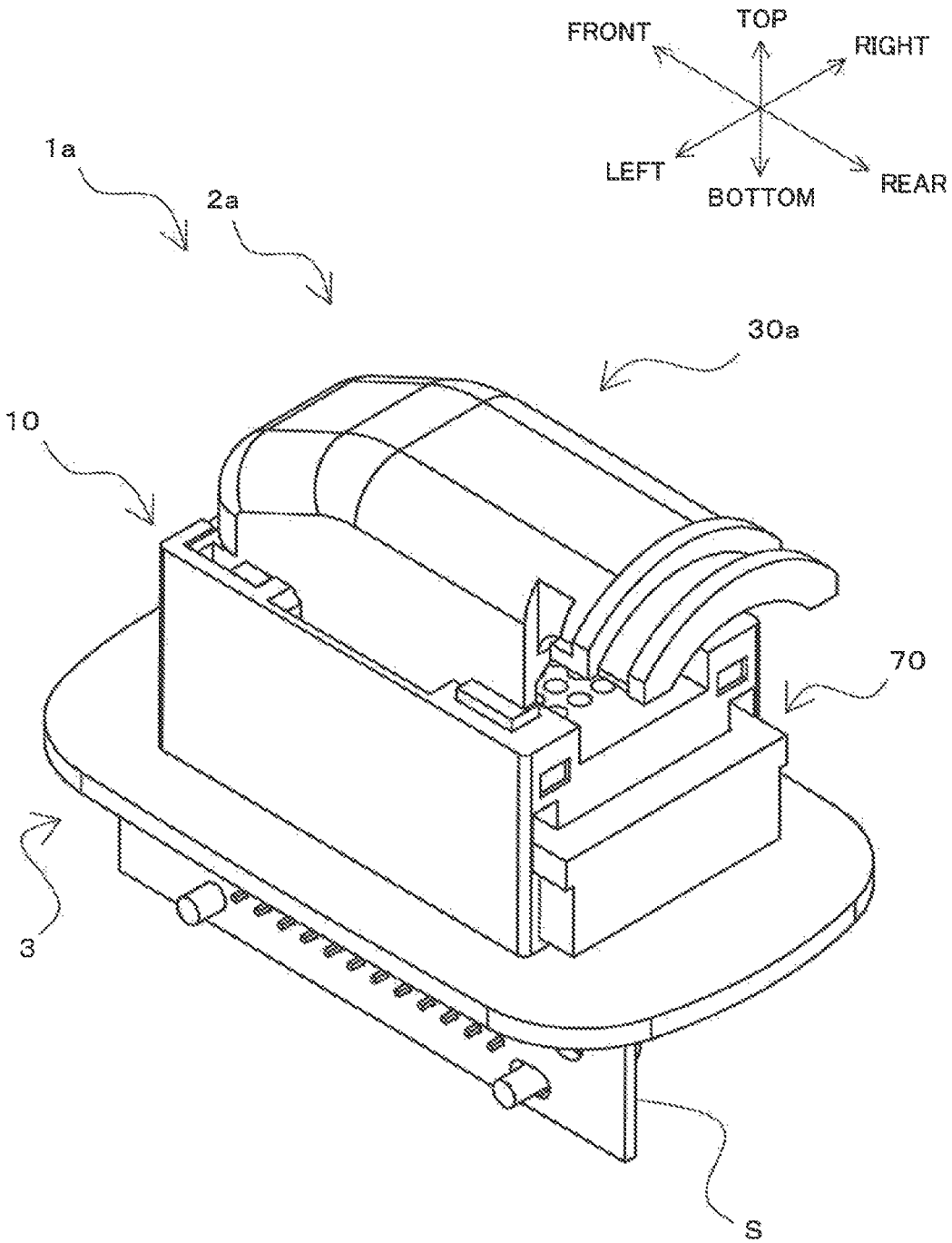
FIG. 12 is a perspective view of an electrical connection device according to a modification, when viewed from a rear side.
Figure 13:
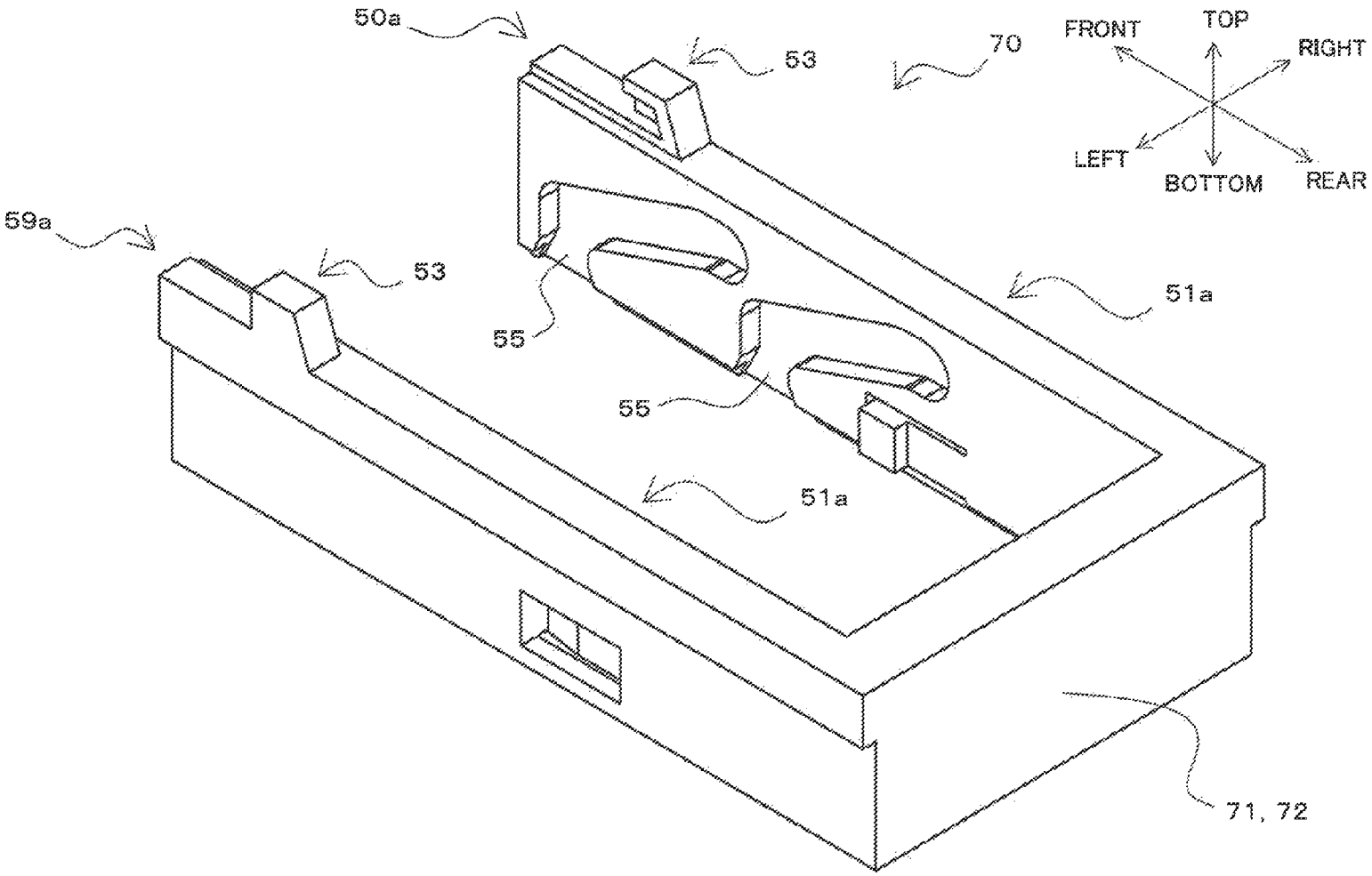
FIG. 13 is a perspective view of a slider that is equipped with a lever, and is included in a connector of the electrical connection device shown in FIG. 12.

Modifications (1) FIG. 12 is a perspective view of an electrical connection device 1*a* according to a modification, viewed from a rear side. FIG. 13 is a perspective view of a slider 70 that is equipped with a lever, and is included in a connector 2*a* of the electrical connection device 1*a* shown in FIG. 12.

Although the embodiment above has been described based on an example in which the sliders 50 and 59 are operated by using the lever 60, the present invention is not limited to such an example. Specifically, as in the modification shown in FIG. 12, the connector 2*a*, from which the lever 60 has been omitted, may be configured.

As shown in FIG. 12, the connector 2*a* according to the present modification includes the housing 10, a cover 30*a*, the slider 70 that is equipped with a lever, and a plurality of female contacts (not shown). That is, the connector 2*a* according to the present modification has a configuration in which the lever 60 and the sliders 50 and 59 are omitted, when compared with the above-described embodiment, and the slider 70 that is equipped with a lever is provided instead.

In the connector 2 according to the above-described embodiment, the sliders 50 and 59 slide in the front-rear direction upon the lever 60 being operated to rotate. In this regard, with the connector 2*a* according to the present modification, it is possible to slide the slider portions in the front-rear direction by operating the lever portion that is integrated with the slider portions, in the front-rear direction. Also, the connector 2*a* according to the present modification is slightly different from the above-described embodiment in the configuration of the cover 30*a*. The following mainly describes points that differ from the above-described embodiment, and descriptions of other points are omitted.

Although the configuration of the cover 30*a* is different from that of the cover 30 according to the above-described embodiment in that the pivots 37 are omitted, the cover 30*a* is otherwise the same as the cover 30. Therefore, descriptions of other points are omitted.

FIG. 13 is a perspective view showing the configuration of the slider 70 that is equipped with a lever. The slider 70 that is equipped with a lever includes a right-side slider part 50*a*, a left-side slider part 59*a*, and a coupling part 71, which are integrated into one piece.

The right-side slider part 50*a* is different from the right-side slider 50 according to the above-described embodiment in that the rack part 52 and the extension part 54 are omitted, and that the length of the slider main body 51*a* is slightly longer in the front-rear direction compared to the case of the above-described embodiment. Also, a rear end portion of the right-side slider part 50*a* is integrated with the coupling part 71 that will be described in detail below.

The left-side slider part 59*a* is also different from the left-side slider 59 according to the above-described embodiment in that the rack part 52 and the extension part 54 are omitted, and that the length of the slider main body 51*a* is slightly longer in the front-rear direction compared to the case of the above-described embodiment. Also, a rear end portion of the left-side slider part 59*a* is integrated with the coupling part 71 that will be described in detail below.

The coupling part 71 is a part that is formed in a plate-like shape that extends in the left-right direction, and couples a rear end portion of the right-side slider part 50*a* and a rear end portion of the left-side slider part 59*a* to each other. The coupling part 71 is provided as an operation-target part 72 that is to be operated by the user.

In the electrical connection device 1*a* according to the present modification, the operation-target part 72 is pressed forward in a situation where the connector 2*a* is placed on the partner connector 3. Consequently, the slider parts 50*a* and 59*a* slide forward, and the connector 2*a* is pressed toward the partner connector 3. Thus, as in the case of the above-described embodiment, fitting of the connector 2*a* and the partner connector 3 to each other is complete. Also, in this situation, in the connector 2*a* according to the present modification, in the same manner as in the case of the above-described embodiment, the slider engagement parts 53 engage with the second cover engagement parts 41, and the cover 30*a* is prevented from being detached from the housing 10. As described above, with the connector 2*a* according to the present modification, the fitting performance of the cover 30*a* when fitted to the housing 10 is improved in the same manner as in the case of the above-described modification.

Figure 14:
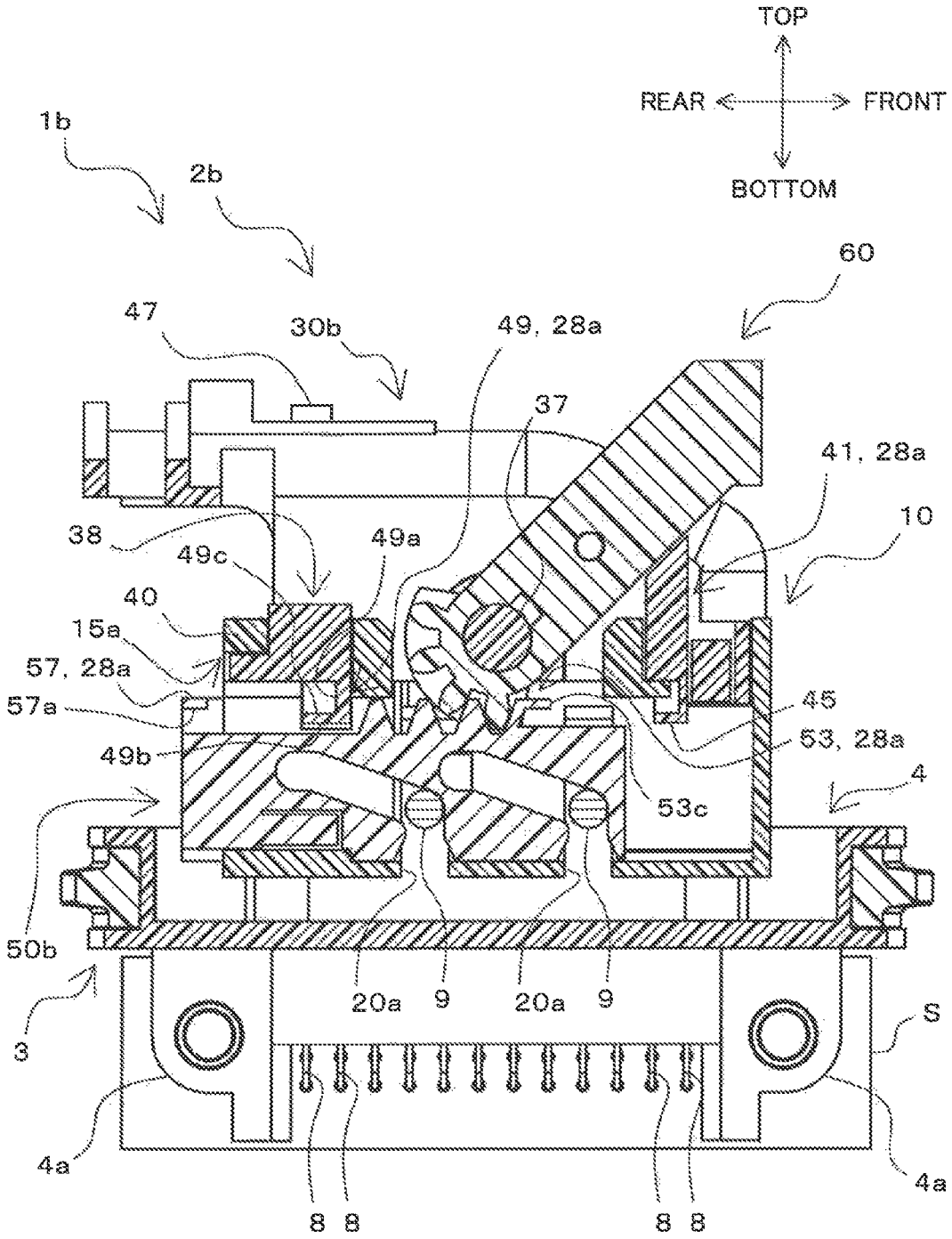
FIG. 14 is a cross-sectional view of an electrical connection device according to a modification.
Figure 15:
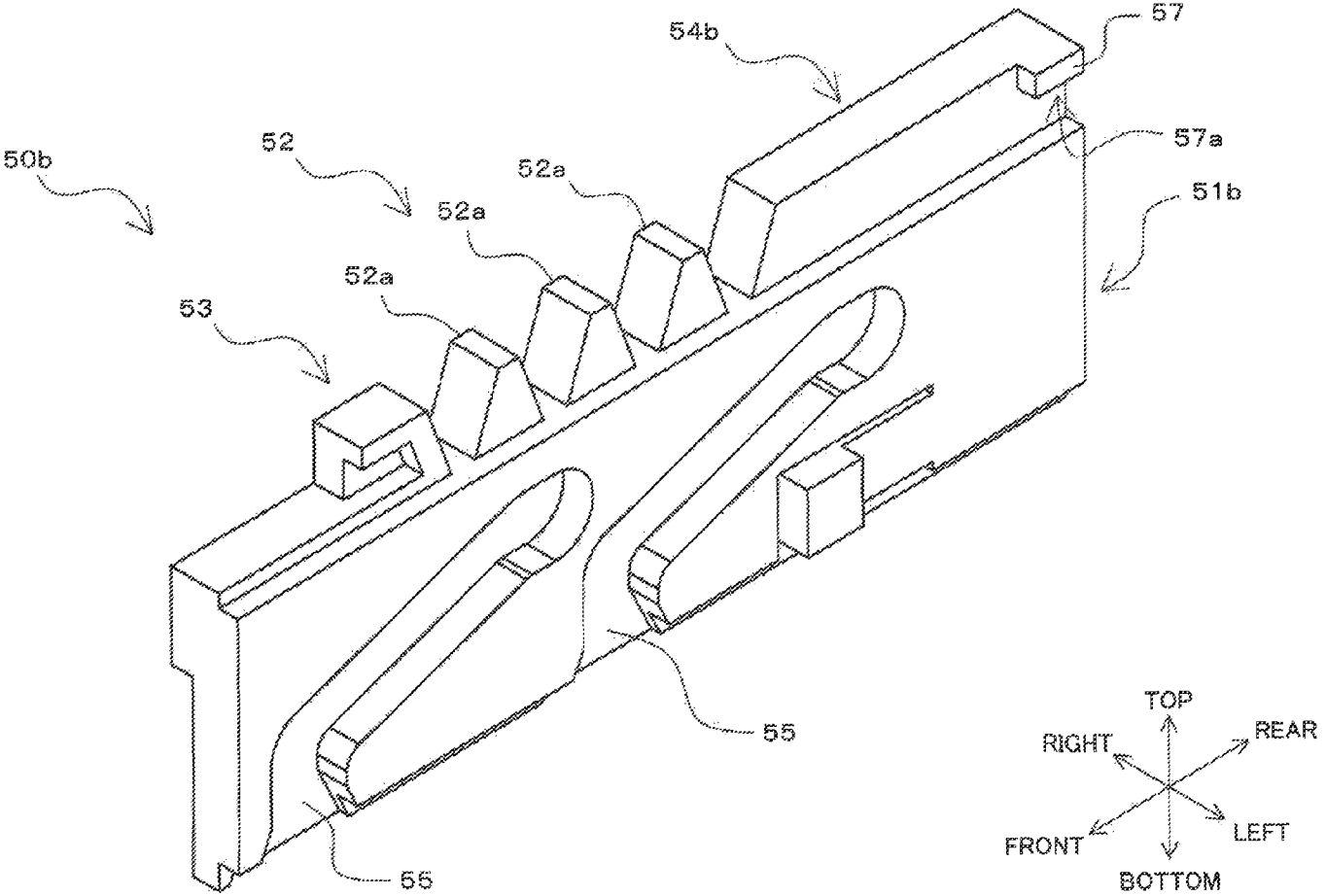
FIG. 15 is a perspective view of a right-side slider that is shown in FIG. 14.

(2) FIG. 14 is a cross-sectional view of an electrical connection device 1*b* according to a modification. FIG. 15 is a perspective view of a right-side slider 50*b* that is shown in FIG. 14.

Although the electrical connection device 1 according to the embodiment above has been described based on an example in which the sliders 50 and 59 each have one slider engagement part 53, the present invention is not limited to such an example. Sliders 50*b* that are included in a connector 2*b* according to the present modification each have two slider engagement parts 53 and 57. In the following description, the slider engagement part 53 may be referred to as "the front-side slider engagement part 53" and the slider engagement part 57 may be referred to as "the rear-side slider engagement part 57" in some cases. Also, although not shown in the drawings, the left-side slider according to the present modification is shaped so as to be bilaterally symmetrical to the right-side slider 50*b*.

The right-side slider 50*b* according to the present modification includes a slider main body 51*b*, the rack part 52, the slider engagement part 53, an extension part 54*b*, and the cam grooves 55. Among these parts, the rack part 52, the slider engagement part 53, and the cam grooves 55 are the same as those of the right-side slider 50 according to the above-described embodiment, and therefore descriptions thereof are omitted.

The slider main body 51*b* is, as in the case of the above-described embodiment, a plate-like part that has a predetermined thickness in the left-right direction, and is formed such that the length thereof in the front-rear direction is longer than the length thereof in the top-bottom direction. However, the slider main body 51*b* according to the present modification is formed such that the length thereof in the front-rear direction is slightly longer compared to the above-described embodiment.

The extension part 54*b* is, as in the case of the above-described embodiment, an elongated protruding part that is formed on the upper end surface of the slider main body 51*b*, and is formed so as to extend from a portion that is slightly rearward of the rack part 52 to the rear end surface of the slider main body 51*b*. However, the extension part 54*b* is formed such that the length thereof in the front-rear direction is slightly longer compared to the above-described embodiment.

As shown in FIG. 14, the rear-side slider engagement part 57 (the second surface part) is configured to engage with a fourth cover engagement part 49 that is formed on a cover 30*b*. The rear-side slider engagement part 57 is provided as a rectangular part that protrudes inward from an upper portion of a rear end portion of the extension part 54*b*. The lower surface of the rear rear-side slider engagement part 57 is provided as a second surface 57*a* that is formed as a flat surface.

As shown in FIG. 14, fourth cover engagement parts 49 are formed on the cover 30*b*. The fourth cover engagement parts 49 are formed on the lower end surfaces of the first cover engagement parts 38. Each of the fourth cover engagement parts 49 includes: an extension part 49*a* that extends downward from the lower end surface of the corresponding first cover engagement part 38; and a claw part 49*b* (the first surface part) that is formed in a plate-like shape that extends rearward from a tip end portion of the extension part 49*a*, which are integrated into one piece. The upper surfaces of the claw parts 49*b* are each provided as a first surface 49*c* that is formed as a flat surface.

In the electrical connection device 1*b* according to the present modification, upon the lever 60 being operated to the rear side in the situation shown in FIG. 14 (a situation where the connector 2*b* is yet to be fitted to the partner connector 3) and the connector 2*b* is fitted to the partner connector 3, not only the front-side slider engagement part 53 but also the rear-side slider engagement part 57 engages with the cover 30*b*. In other words, in the present modification, a lock mechanism 28*a* includes the second cover engagement parts 41, the front-side slider engagement parts 53, the fourth cover engagement parts 49, and the rear-side slider engagement parts 57. In the present modification, in a situation where the connector 2*b* is fitted to the partner connector 3, each of the sliders 50*b* engages with the cover 30*b* at two positions. With this configuration, the fitting performance of the cover 30*b* when fitted to the housing 10 is further improved compared to the case of the above-described embodiment.

Figure 16:
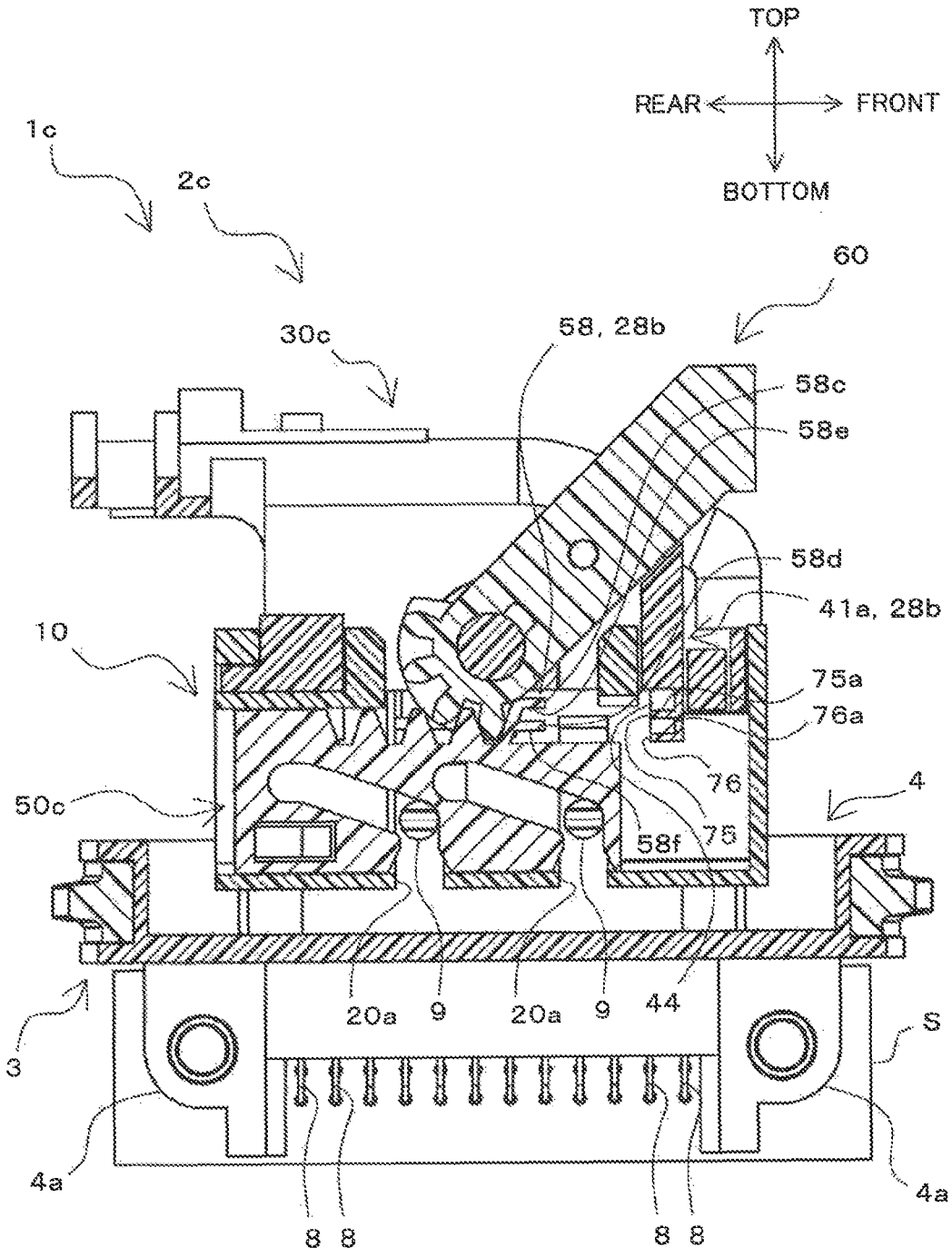
FIG. 16 is a cross-sectional view of an electrical connection device according to a modification.
Figure 17:
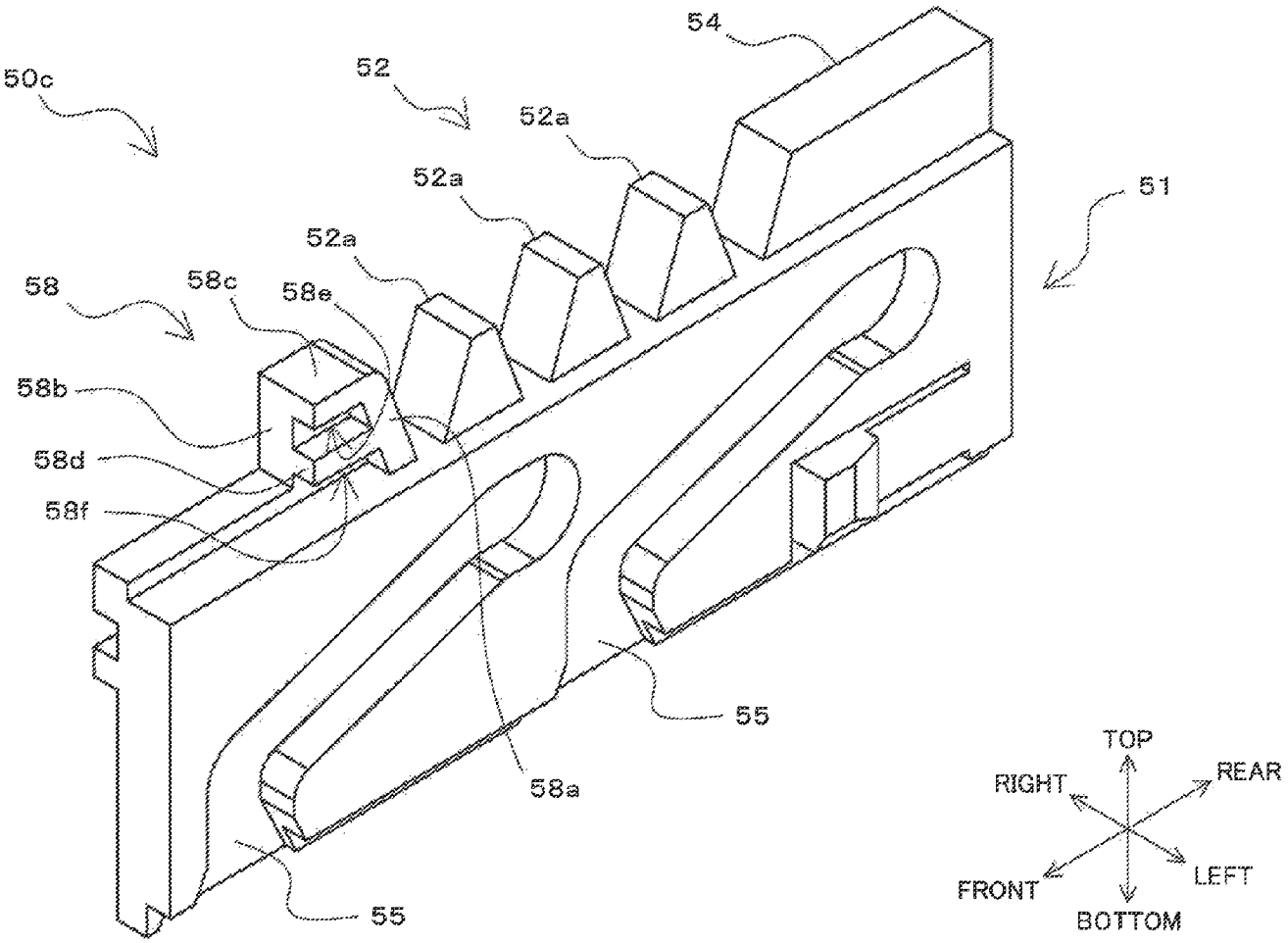
FIG. 17 is a perspective view of a right-side slider that is shown in FIG. 16.

(3) FIG. 16 is a cross-sectional view of an electrical connection device 1*c* according to a modification. FIG. 17 is a perspective view of a right-side slider 50*c* that is shown in FIG. 16.

The electrical connection device 1*b* according to the modification illustrated with reference to FIGS. 14 and 15 has been illustrated based on an example in which, as shown in FIG. 14, the first surface parts and the second surface parts, which face each other in the top-bottom direction, are provided with a gap therebetween in the front-rear direction. Specifically, the electrical connection device 1*b* has been described based on an example in which the second claw parts 45 serving as the first surface parts and the flat surface parts 53*c* serving as the second surface parts are provided on the front side, and the claw parts 49*b* serving as the first surface parts and the rear-side slider engagement parts 57 serving as the second surface parts are provided on the rear side. However, the present invention is not limited to such an example, and each pair of a first surface part and a second surface may be provided with a gap therebetween in the top-bottom direction.

As shown in FIG. 17, the right-side slider 50*c* according to the present modification includes the slider main body 51, the rack part 52, the extension part 54, the cam grooves 55, and a slider engagement part 58. Among these parts, the rack part 52, the extension part 54, and the cam grooves 55 are the same as those of the right-side slider 50 according to the above-described embodiment, and therefore descriptions thereof are omitted.

The slider engagement part 58 is formed on a portion that is slightly forward of the rack part 52 as in the case of the slider engagement part 53 according to the above-described embodiment. The slider engagement part 58 includes a first extension part 58*a*, a second extension part 58*b*, an upper flat surface part 58*c* (a second surface part), and a lower flat surface part 58*d* (a second surface part), which are integrated into one piece.

The first extension part 58*a* is formed so as to extend from a portion that is slightly forward of the rack part 52, in an upward direction by a certain distance. The first extension part 58*a* is a flake-like part that has a thickness in the front-rear direction.

The second extension part 58*b* is formed so as to extend from a portion that is slightly forward of the rack part 52, in an upward direction by a certain distance, in the same manner as in the case of the first extension part 58*a*. The second extension part 58*b* is a flake-like part that has a thickness in the left-right direction, and a rear end portion thereof is integrated with an outer portion of the first extension part 58*a* (a right-side portion in the case of the right-side slider 50*c*).

The flat surface part 58*c* is a flat part that covers, from above, a space that is surrounded by the first extension part 58*a* and the second extension part 58*b*. The flat surface part 58*c* is formed so as to have a rectangular shape when viewed from above, and has a predetermined thickness in the top-bottom direction. The lower surface of the flat surface part 58*c* is provided as a second surface 58*e* that is formed as a flat surface.

The lower flat surface part 58*d* is provided between the lower surface of the upper flat surface part 58*c* and an upper end surface of the slider main body 51. The lower flat surface part 58*d* has a predetermined thickness in the top-bottom direction. The lower surface of the lower flat surface part 58*d* is provided as a second surface 58*f* that is formed as a flat surface.

As shown in FIG. 16, an upper claw part 75 (a first surface part) and a lower claw part 76 (a first surface part) are formed on a second cover engagement part 41*a* of a cover 30*c*. The upper claw part 75 is provided as a small cuboid part that protrudes slightly outward (to the right side in FIG. 16) from a middle portion of the second extension part 44 in the top-bottom direction. The upper surface of the upper claw part 75 is provided as a first surface 75*a* that is formed as a flat surface. The lower claw part 76 is formed as a small cuboid part that protrudes slightly outward from a lower end portion of the second extension part 44. The lower claw part 76 has a predetermined thickness in the top-bottom direction. The upper surface of the lower claw part 76 is provided as a first surface 76*a* that is formed as a flat surface.

In the electrical connection device 1*c* according to the present modification, a lock mechanism 28*b* includes the second cover engagement parts 41*a* and the slider engagement parts 58. In the electrical connection device 1*c* according to the present modification, upon the lever 60 being operated to the rear side in the situation shown in FIG. 16 (a situation where the connector 2*c* is yet to be fitted to the partner connector 3) and the connector 2*c* is fitted to the partner connector 3, the upper flat surface parts 58*c* engage with the upper claw parts 75, and the lower flat surface parts 58*d* engage with the lower claw parts 76. In other words, in the present modification, in a situation where the connector 2*c* is fitted to the partner connector 3, each of the sliders engage with the cover 30*c* at two positions. With this configuration, the fitting performance of the cover 30*c* when fitted to the housing 10 can be improved in the same manner as in the case of the modification described with reference to FIGS. 14 and 15.

(4) Although the embodiment above has been described based on an example in which the cam grooves 55 are formed in the sliders 50 and 59 whereas the protrusions 9 that are guided by the cam grooves 55 are formed on the partner connector 3, the present invention is not limited to such an example, and the protrusions may be formed on the sliders, and cam grooves may be formed in the partner connector. Even with such a configuration, it is possible to fit the connector and the partner connector to each other by operating the lever, in the same manner as in the above-described embodiment.

(5) Although the embodiment above has been described based on an example in which the electrical connection device 1 has the seal ring 7 and the retainer, the present invention is not limited to such an example, and is also applicable to an electrical connection device that has only one of the sealing ring 7 and the retainer, and an electrical connection device that does not have the sealing ring 7 or the retainer.

The present invention is broadly applicable to connectors and electrical connection devices. The present invention is not limited to the above-described embodiments, and all modifications, applications and equivalents thereof that fall within the scope of claims, for which modifications and applications would become apparent by reading and understanding the present specification, are intended to be embraced therein.

What is claimed is:

1. A connector that is to be fitted to a partner connector, comprising:

a housing that has an opening that opens in a direction that is opposite a fitting direction in which the connector is fitted to the partner connector;

a cover that includes a first cover engagement part that engages with a housing engagement part that is formed on the housing, and is fixed to the housing so as to cover the opening;

a slider that is housed within the housing, is provided so as to be slidable along the housing in a sliding direction that is a direction that intersects the fitting direction, and is configured to slide in the sliding direction so that the housing is fitted to the partner connector;

an operation-target part configured to slide the slider upon being operated; and a lock mechanism that includes a slider engagement part that is formed on the slider, and a second cover engagement part that is formed on the cover, and is configured such that the slide engagement part engages with the second cover engagement part in a situation where fitting of the housing and the partner connector to each other is complete, so that the cover is prevented from being separated from the slider.

2. The connector according to claim 1, wherein the second cover engagement part has a first surface part on which a first surface is formed, the first surface extending in a direction that is orthogonal to the fitting direction, and the slider engagement part has a second surface part on which a second surface is formed and that is located in a direction that is opposite the fitting direction, relative to the first surface part, the second surface extending in a direction that is orthogonal to the fitting direction, and facing the first surface part in a situation where fitting of the housing and the partner connector to each other is complete.

3. The connector according to claim 2, wherein the first surface part is provided in a plurality, and the second surface part is provided in a plurality such that the plurality of second surface parts respectively engage with the plurality of first surface parts.

4. The connector according to claim 2, wherein the second surface part is formed on a portion of the slider, the portion being located on the cover side.

5. An electrical connection device comprising:

the connector according to claim 1, and a partner connector that is fitted to the connector.

* * * * *